US009702152B2

(12) United States Patent
Sievers et al.

(10) Patent No.: US 9,702,152 B2
(45) Date of Patent: Jul. 11, 2017

(54) PREFABRICATED WALL ASSEMBLY HAVING AN OUTER FOAM LAYER

(75) Inventors: Michael J. Sievers, Mullica Hill, NJ (US); Michael J. McNulty, Charlotte, NC (US); Michael Drewery, Monroe, NC (US); Rick Davenport, Fortmill, SC (US); Mary Poma, Pleasant Ridge, MI (US); Paul J. Fox, Saline, MI (US); Colby A. Swanson, Jersey City, NJ (US)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 14/126,664

(22) PCT Filed: Jun. 15, 2012

(86) PCT No.: PCT/US2012/042718
§ 371 (c)(1),
(2), (4) Date: Dec. 16, 2013

(87) PCT Pub. No.: WO2012/174408
PCT Pub. Date: Dec. 20, 2012

(65) Prior Publication Data

US 2014/0115989 A1 May 1, 2014

Related U.S. Application Data

(60) Provisional application No. 61/498,092, filed on Jun. 17, 2011.

(51) Int. Cl.
*E04C 1/00* (2006.01)
*E04F 13/08* (2006.01)
(Continued)

(52) U.S. Cl.
CPC ..... *E04F 13/0869* (2013.01); *E04B 2/02* (2013.01); *E04C 2/386* (2013.01); *Y10T 29/49623* (2015.01)

(58) Field of Classification Search
CPC ..... E04C 2/384; E04C 2/205; E04B 2/847
(Continued)

(56) References Cited

U.S. PATENT DOCUMENTS 1,028,725 A 6/1912 Hodgson
1,549,292 A 8/1925 Buttress
(Continued)

FOREIGN PATENT DOCUMENTS

BE 1010844 A3 2/1999
CA 2019852 A1 12/1990
(Continued)

OTHER PUBLICATIONS

Brochure, "Modular Wall Panel Technology" extracted from www.nu-techbuildingsystenns.com/modular_panel_technology.php on Aug. 23, 2010, 7 pages.
(Continued)

*Primary Examiner* — Basil Katcheves
*Assistant Examiner* — Joshua Ihezie
(74) *Attorney, Agent, or Firm* — Howard & Howard Attorneys PLLC

(57) ABSTRACT

A prefabricated wall assembly receives an exterior covering of a building. The prefabricated wall assembly comprises a frame assembly and an outer foam layer. The outer foam layer is coupled to the frame assembly. The outer foam layer extends from the frame assembly to an exterior surface of the outer foam layer. The exterior surface of the outer foam layer is configured to receive the exterior covering of the building. The outer foam layer comprises a plurality of particles and a binder that define a plurality of pathways. The
(Continued)

pathways extend vertically through the prefabricated wall assembly from the top member to the bottom member of the frame assembly for allowing airflow and drainage between the frame assembly and the exterior covering.

11 Claims, 8 Drawing Sheets

(51) Int. Cl.
*E04C 2/38* (2006.01)
*E04B 2/02* (2006.01)

(58) Field of Classification Search
USPC ..... 52/309.12, 309.7, 481.1, 602
See application file for complete search history.

(56) References Cited

U.S. PATENT DOCUMENTS 2,015,817 A 4/1926 Schmidt
1,637,410 A 8/1927 Coryell
1,914,345 A 7/1932 Roos
2,116,270 A 5/1938 Le Grand
2,318,820 A 5/1943 Voigt et al.
2,324,971 A 7/1943 Woodward
2,514,170 A 7/1950 Walter et al.
2,553,881 A 5/1951 Suttles
2,645,824 A 7/1953 Titsworth
2,755,728 A 7/1956 Frisby
2,767,961 A 10/1956 Frankland
2,876,871 A 3/1959 Coffman et al.
3,006,113 A 10/1961 Barnes et al.
3,086,323 A 4/1963 Pine
3,115,819 A 12/1963 Mahlmeister et al.
3,147,336 A 9/1964 Mathews
3,160,987 A 12/1964 Pinkley
3,196,773 A 7/1965 Lorenz et al.
3,251,163 A 5/1966 Russell
3,258,889 A * 7/1966 Butcher ..... 52/309.11
3,295,278 A 1/1967 Muhm
3,343,474 A 9/1967 Sohda et al.
3,368,473 A 2/1968 Sohda et al.
3,482,367 A 12/1969 Curran
3,595,728 A 7/1971 Robson
3,605,365 A * 9/1971 Hastings ..... 52/309.11
3,616,139 A 10/1971 Jones
3,633,659 A 1/1972 Ohlsson
3,683,785 A 8/1972 Grange
3,736,715 A * 6/1973 Krumwiede ..... 52/309.11
3,748,803 A 7/1973 Widerby et al.
3,756,895 A 9/1973 Bellamy
3,780,638 A 12/1973 Burghartz et al.
3,783,563 A 1/1974 Moore
3,785,913 A * 1/1974 Hallamore ..... 428/71
3,789,747 A 2/1974 Wasserman et al.
3,797,180 A 3/1974 Grange
3,816,234 A 6/1974 Winfield
3,868,796 A 3/1975 Bush
3,885,008 A * 5/1975 Martin ..... 264/45.3
3,952,471 A 4/1976 Mooney
3,972,164 A 8/1976 Grange
3,982,360 A 9/1976 Newman
4,019,297 A * 4/1977 Murphy ..... 52/309.2
4,028,289 A 6/1977 Brown
4,047,355 A * 9/1977 Knorr ..... 52/481.1
4,057,123 A 11/1977 Erickson
4,067,155 A 1/1978 Ruff et al.
4,069,628 A 1/1978 Kreimer
4,080,881 A 3/1978 Campbell
4,096,790 A 6/1978 Curran
4,099,355 A 7/1978 Strunk
4,102,092 A 7/1978 Ward
4,104,840 A 8/1978 Heintz et al.
4,125,971 A 11/1978 Ward
4,185,437 A * 1/1980 Robinson ..... 52/601
4,201,121 A 5/1980 Brandenburg, Jr.
4,214,510 A 7/1980 Ward
4,223,489 A 9/1980 Bentley
4,237,672 A 12/1980 Peterson
4,254,598 A 3/1981 Rugroden
4,286,420 A 9/1981 Pharmakidis
4,295,304 A 10/1981 Kim
4,308,308 A 12/1981 Sachse
4,333,290 A 6/1982 Koberstein
4,344,413 A 8/1982 Watkins et al.
4,346,541 A 8/1982 Schmitt
4,382,435 A 5/1983 Brill-Edwards
4,397,122 A 8/1983 Cros
4,429,503 A 2/1984 Holliday
4,446,661 A 5/1984 Jonsson et al.
4,453,359 A * 6/1984 Robinson ..... 52/389
4,471,591 A 9/1984 Jamison
4,593,511 A 6/1986 Hakasaari
4,635,419 A 1/1987 Forrest
4,637,190 A 1/1987 Minialoff et al.
4,641,469 A 2/1987 Wood
4,660,463 A 4/1987 Bottomore et al.
4,661,533 A 4/1987 Stobby
4,677,903 A 7/1987 Mathews, III
4,683,688 A 8/1987 Wojcinski
4,698,366 A * 10/1987 Laan ..... C04B 28/02 521/54
4,736,561 A 4/1988 Lehr et al.
4,754,587 A 7/1988 Glaser
4,832,308 A 5/1989 Slonimsky et al.
4,852,314 A 8/1989 Moore, Jr.
4,858,403 A 8/1989 Lingle
4,916,875 A 4/1990 Kashiwagi
4,942,711 A 7/1990 Bergquist
4,960,184 A * 10/1990 Woodward ..... 181/287
4,995,308 A 2/1991 Waggoner
5,009,043 A * 4/1991 Kurrasch ..... E04B 1/8227 181/290
5,033,248 A * 7/1991 Phillips ..... 52/742.14
5,102,260 A 4/1992 Horvath et al.
5,172,532 A * 12/1992 Gibbar, Jr. ..... 52/309.12
5,192,598 A 3/1993 Forte et al.
5,224,315 A 7/1993 Winter, IV
5,279,089 A * 1/1994 Gulur ..... 52/309.11
5,293,728 A 3/1994 Christopher et al.
5,327,699 A * 7/1994 Khan et al. ..... 52/93.2
5,341,612 A 8/1994 Robbins
5,373,678 A 12/1994 Hesser
5,425,207 A 6/1995 Shayman
5,425,908 A 6/1995 Merser
5,426,908 A 6/1995 Shayman
5,433,050 A 7/1995 Wilson et al.
5,473,847 A 12/1995 Crookston
5,487,247 A 1/1996 Pigg
5,497,589 A 3/1996 Porter
5,509,242 A 4/1996 Rechsteiner et al.
5,522,195 A 6/1996 Bargen
5,526,629 A * 6/1996 Cavaness ..... 52/745.19
5,533,311 A 7/1996 Tirrell et al.
5,596,847 A 1/1997 Stephenson
5,600,928 A 2/1997 Hess et al.
5,612,117 A 3/1997 Belanger et al.
5,644,878 A 7/1997 Wehrmann
5,743,055 A 4/1998 Conner et al.
5,758,463 A * 6/1998 Mancini, Jr. ..... 52/309.12
5,761,864 A * 6/1998 Nonoshita ..... 52/302.3
5,765,330 A * 6/1998 Richard ..... 52/309.13
5,766,071 A 6/1998 Kirkwood
5,771,645 A * 6/1998 Porter ..... 52/220.2
5,771,654 A * 6/1998 Moore et al. ..... 52/742.14
5,787,665 A * 8/1998 Carlin et al. ..... 52/309.4
5,806,264 A * 9/1998 Boot ..... 52/415
5,860,259 A 1/1999 Laska
5,884,446 A 3/1999 Hageman
5,910,082 A 6/1999 Bender et al.
5,943,775 A 8/1999 Lanahan et al.
5,953,883 A 9/1999 Ojala
6,026,629 A * 2/2000 Strickland et al. ..... 52/794.1
6,032,434 A 3/2000 Graf

(56) References Cited

U.S. PATENT DOCUMENTS 6,041,561 A * 3/2000 LeBlang ..... 52/234
6,061,973 A 5/2000 Accardi et al.
6,061,978 A 5/2000 Dinwoodie et al.
6,067,770 A 5/2000 Lubker, II et al.
6,085,469 A 7/2000 Wolfe
6,085,485 A 7/2000 Murdock
6,088,992 A 7/2000 Nunley
6,099,768 A * 8/2000 Strickland et al. ..... 264/46.4
6,122,879 A 9/2000 Montes
6,141,932 A 11/2000 Tarrant
6,185,895 B1 2/2001 Rettew
6,212,837 B1 4/2001 Davis et al.
6,220,956 B1 4/2001 Kilian et al.
6,226,943 B1 5/2001 Grinshpun et al.
6,279,287 B1 8/2001 Meadows
6,279,290 B1 8/2001 Richardson
6,279,293 B1 8/2001 Ojala
6,280,669 B2 8/2001 Kistner et al.
6,305,142 B1 * 10/2001 Brisson et al. ..... 52/742.14
6,383,652 B1 5/2002 Templeton et al.
6,401,417 B1 * 6/2002 Leblang ..... 52/481.1
6,415,580 B2 7/2002 Ojala
6,519,904 B1 * 2/2003 Phillips ..... 52/309.12
6,571,523 B2 * 6/2003 Chambers ..... 52/309.2
6,588,172 B2 7/2003 Porter
6,589,660 B1 7/2003 Templeton et al.
6,619,008 B1 9/2003 Shivak et al.
6,688,059 B1 2/2004 Walker
6,688,073 B2 2/2004 VanderWerf et al.
6,715,249 B2 4/2004 Rusek et al.
6,729,094 B1 * 5/2004 Spencer et al. ..... 52/414
6,772,569 B2 8/2004 Bennett et al.
6,780,099 B1 8/2004 Harper
6,789,645 B1 * 9/2004 Deblander ..... 181/290
6,802,157 B2 10/2004 Hallsten
6,854,230 B2 * 2/2005 Starke ..... 52/481.1
6,869,661 B1 3/2005 Ahr
6,886,301 B2 * 5/2005 Schilger ..... 52/302.1
6,941,706 B2 9/2005 Austin et al.
7,143,557 B1 12/2006 Ayers, Jr.
7,165,369 B2 1/2007 Jandl
7,168,216 B2 * 1/2007 Hagen, Jr. ..... 52/480
7,247,090 B2 7/2007 Vacek
7,398,856 B2 * 7/2008 Foster et al. ..... 181/285
7,543,419 B2 6/2009 Rue
7,574,837 B2 * 8/2009 Hagen et al. ..... 52/404.1
7,591,109 B2 9/2009 Rotter
7,610,729 B1 11/2009 Ayers, Jr.
7,735,267 B1 6/2010 Ayers, Jr.
7,749,598 B2 7/2010 Agrawal
7,765,750 B2 8/2010 Duncan
7,765,756 B2 8/2010 Bontrager, II
7,810,296 B1 10/2010 Turku
7,818,922 B2 10/2010 Ellis
7,926,233 B2 4/2011 Schiffmann et al.
7,946,384 B2 * 5/2011 Foster et al. ..... 181/290
8,024,894 B1 9/2011 Ayers, Jr.
8,100,341 B1 1/2012 Roderick et al.
8,104,245 B2 1/2012 Whelan et al.
8,122,664 B2 2/2012 Ben-Daat et al.
8,122,666 B2 2/2012 Gupta
8,137,170 B2 3/2012 Klement
8,152,608 B1 4/2012 Hamby
8,176,699 B1 5/2012 Birchfield
8,178,643 B2 5/2012 Edstrom et al.
8,240,103 B2 8/2012 Riepe
8,245,947 B2 8/2012 Roderick et al.
8,453,404 B2 * 6/2013 Cox ..... 52/309.7
8,613,180 B2 12/2013 Strickland et al.
8,695,299 B2 4/2014 Propst
8,745,950 B2 6/2014 Ito et al.
8,793,952 B2 8/2014 Olang
8,925,270 B2 1/2015 Grisolia et al.
2002/0020129 A1 2/2002 Winter
2003/0126806 A1 7/2003 Ellis
2003/0150183 A1 8/2003 Egan
2003/0172613 A1 9/2003 Fontana et al.
2004/0000113 A1 1/2004 Alderman
2004/0148889 A1 8/2004 Bibee et al.
2005/0055982 A1 3/2005 Medina
2005/0072072 A1 4/2005 Duncan et al.
2005/0076600 A1 4/2005 Moody et al.
2005/0144900 A1 * 7/2005 Hallissy et al. ..... 52/782.1
2005/0163881 A1 7/2005 Pierick et al.
2005/0166496 A1 8/2005 Farag
2005/0188649 A1 9/2005 Hagen, Jr.
2005/0204697 A1 9/2005 Rue
2005/0204699 A1 9/2005 Rue
2005/0255318 A1 * 11/2005 Czerny ..... 428/402
2006/0068188 A1 3/2006 Morse et al.
2006/0117689 A1 * 6/2006 Onken et al. ..... 52/309.7
2006/0185267 A1 8/2006 Tonyan et al.
2006/0201089 A1 9/2006 Duncan et al.
2006/0251851 A1 11/2006 Bowman
2006/0260267 A1 * 11/2006 Hagen et al. ..... 52/745.19
2007/0034110 A1 * 2/2007 Zupancich et al. ..... 105/355
2007/0062151 A1 * 3/2007 Smith ..... 52/782.1
2007/0234649 A1 10/2007 Near et al.
2007/0234667 A1 10/2007 Lubker, II et al.
2007/0294976 A1 12/2007 Fay
2008/0047217 A1 2/2008 Browning et al.
2008/0193712 A1 8/2008 Desjardins
2008/0260993 A1 10/2008 Koester
2008/0295450 A1 * 12/2008 Yogev ..... 52/783.1
2009/0056255 A1 * 3/2009 Barton ..... 52/309.7
2009/0100780 A1 4/2009 Mathis et al.
2009/0107065 A1 4/2009 LeBlang
2009/0239059 A1 * 9/2009 Kipp et al. ..... 428/323
2009/0255201 A1 10/2009 Kraus, Jr. et al.
2009/0308001 A1 12/2009 Wu et al.
2010/0058700 A1 * 3/2010 LeBlang ..... 52/506.05
2010/0095613 A1 4/2010 Paetkau et al.
2010/0107539 A1 5/2010 Martens et al.
2010/0269439 A1 * 10/2010 Morrisette ..... 52/309.4
2010/0307089 A1 * 12/2010 Cox ..... 52/309.4
2011/0024050 A1 2/2011 Booth et al.
2011/0036030 A1 2/2011 Hegland
2011/0047908 A1 3/2011 Brusman et al.
2011/0094175 A1 4/2011 Groft
2011/0107723 A1 5/2011 Hurlburt
2011/0239574 A1 10/2011 Morris et al.
2011/0258944 A1 10/2011 Radoane
2011/0296794 A1 12/2011 Thomas et al.
2011/0314759 A1 12/2011 McCullough
2012/0011792 A1 1/2012 DeWildt et al.
2012/0100289 A1 4/2012 Egan et al.
2012/0151869 A1 6/2012 Miller
2012/0317923 A1 * 12/2012 Herdt et al. ..... 52/783.11
2013/0019549 A1 * 1/2013 Henriquez ..... 52/220.2
2013/0067841 A1 3/2013 Grieco et al.
2013/0081346 A1 * 4/2013 Kulprathipanja et al. ... 52/483.1
2013/0209782 A1 * 8/2013 Kipp et al. ..... 428/313.3
2014/0033627 A1 * 2/2014 Stephens et al. ..... 52/204.5
2014/0053486 A1 * 2/2014 Grisolia et al. ..... 52/309.7
2014/0115988 A1 5/2014 Sievers et al.
2014/0115989 A1 5/2014 Sievers et al.
2014/0115991 A1 5/2014 Sievers et al.
2014/0174011 A1 * 6/2014 Smith ..... 52/309.7
2015/0376898 A1 12/2015 Kreizinger

FOREIGN PATENT DOCUMENTS

CA 1284571 C 6/1991
CA 2006652 A1 6/1991
CA 2097788 A1 12/1993
CA 2081651 A1 4/1994
CA 2174573 A1 10/1996
CZ 302477 B6 6/2011
DE 1281133 B 10/1968
EP 0004216 A1 9/1979
EP 0111235 A2 6/1984
EP 0191709 A1 8/1986
EP 0553414 A1 8/1993
EP 2333474 A2 6/2011

(56) References Cited

FOREIGN PATENT DOCUMENTS

| | | | |
|---|---|---|---|
| ES | 2351467 | A1 | 2/2011 |
| FR | 2421344 | A1 | 10/1979 |
| FR | 2481341 | A1 | 10/1981 |
| FR | 2576943 | A1 | 8/1986 |
| GB | 1097452 | A | 1/1968 |
| GB | 1196469 | A | 6/1970 |
| GB | 2145756 | A | 4/1985 |
| GB | 2196032 | A | 4/1988 |
| JP | H06185130 | A | 7/1994 |
| NL | 1020177 | C2 | 9/2003 |
| SU | 775258 | A1 | 10/1980 |
| WO | WO 0183911 | A1 | 11/2001 |
| WO | WO 2005103407 | A2 | 11/2005 |
| WO | WO 2006028698 | A1 | 3/2006 |
| WO | WO 2011003143 | A1 | 1/2011 |
| WO | WO 2012027353 | A2 | 3/2012 |
| WO | WO 2012/174408 | A2 | 12/2012 |

OTHER PUBLICATIONS

International Search Report for Application No. PCT/US2012/042751 dated Sep. 13, 2012, 3 pages.
International Search Report for Application No. PCT/US12/42667 dated Sep. 7, 2012, 4 pages.
International Search Report for Application No. PCT/US2012/042718 dated Sep. 17, 2012, 3 pages.
English language abstract for CZ 302477 extracted from espacenet.com database on May 12, 2014, 12 pages.
English language translation for DE 1281133 extracted from espacenet.com database on Apr. 30, 2014, 11 pages.
English language abstract for EP 0004216 extracted from espacenet.com database on May 12, 2014, 19 pages.
English language abstract and translation for EP 0111235 extracted from espacenet.com database on Apr. 30, 2014, 14 pages.
English language abstract and translation for EP 0191709 extracted from espacenet.com database on Apr. 30, 2014, 40 pages.
English language translation for ES 2351467 extracted from espacenet.com database on Apr. 30, 2014, 21 pages.
English language abstract and translation for FR 2421344 extracted from espacenet.com on Apr. 30, 2014, 18 pages.
English language abstract and translation for FR 2481341 extracted from espacenet.com on Apr. 30, 2014, 15 pages.
English language translation for FR 2576943 extracted from espacenet.com database on Apr. 30, 2014, 39 pages.
English language abstract and translation for JP H06185130 extracted from epacenet.com database on May 12, 2014, 11 pages.
English language abstract for NL 1020177 extracted from espacenet.com database on Apr. 30, 2012, 21 pages.
English language translation for SU 775258 extracted from espacenet.com database on Apr. 30, 2014, 8 pages.
Handbook of Adhesives and Sealants; Chapter 8: Adhesive Classifications, pp. 279-317, McGraw Hill New York 2000.
Handbook of Adhesives and Sealants; Chapter 10: Adhesive Families, pp. 343-414, McGraw Hill New York 2000.
Handbook of Adhesives and Sealants; Chapter 12: Sealant Classification and Composition, pp. 451-474, McGraw Hill New York 2000.
Handbook of Adhesives and Sealants; Chapter 13: Sealant Familes, pp. 475-499, McGraw Hill New York 2000.
International Search Report for Application No. PCT/US2016/013880 dated Apr. 6, 2016, 2 pages.
International Search Report for Application No. PCT/US2016/013884 dated Apr. 6, 2016, 2 pages.

* cited by examiner

PREFABRICATED WALL ASSEMBLY HAVING AN OUTER FOAM LAYER

CROSS REFERENCE TO RELATED APPLICATION

This application is the National Stage of International Patent Application No. PCT/US2012/042718, filed on Jun. 15, 2012, which claims priority to and all the advantages of U.S. Patent Application No. 61/498,092 filed on Jun. 17, 2011, which is incorporated by reference.

BACKGROUND OF THE INVENTION

1. Field of the Invention

The invention generally relates to a prefabricated wall assembly. More specifically, the invention relates to a prefabricated wall assembly having an outer foam layer.

2. Description of the Related Art

Prefabricated wall assemblies for use as walls of a building, such as residential buildings, or commercial buildings, are known in the art. A conventional prefabricated wall assembly is assembled offsite at a factory or warehouse. After assembly, the conventional prefabricated wall assembly is transported on-site were the building is to be constructed. The conventional prefabricated wall assembly reduces construction time to construct the building and reduces the labor cost for constructing the building.

The conventional prefabricated wall assembly includes a frame assembly. The frame assembly includes a top member, a bottom member spaced from the top member, and a plurality of vertical members disposed between the top and bottom members. Typically, the top, bottom, and vertical members of the frame assembly comprise wood. The top, bottom, and vertical members of the frame assembly are coupled together using fasteners, such as nails or screws.

The conventional prefabricated wall assembly also includes an insulating layer coupled to the frame assembly. Typically, the fasteners are also used to couple the insulating material to the frame assembly. The insulating layer comprises preformed panels made from polystyrene. The insulating layer has a minimum thermal resistance value, or R-value, which depends on the climate in which the building is to be constructed. The thickness of the insulating layer is varied to produce different R-values. However, because the insulating layer comprises panels, which are preformed, a plurality of seams result between adjacent panels. The seams can be a source of reduced R-value and provide a path for weather elements, such as wind and water, to enter the frame assembly, which is undesirable.

The conventional prefabricated wall assembly includes an exterior sheathing, such as plywood or press wood board, adjacent the insulating layer opposite the frame assembly. The exterior sheathing is coupled to the frame assembly with the fasteners. As is the case with the preformed panels of the insulating layer, the exterior sheathing is available in preformed sheets. A plurality of seams are also formed between adjacent preformed sheets of the exterior sheathing. The seams between preformed sheets of the exterior sheathing also provide a pathway for the weather elements to penetrate the frame assembly. Typically, once the weather elements penetrate the conventional prefabricated wall assembly, the weather elements penetrate the frame assembly and eventually the building itself, which causes damage to an interior sheathing, such as drywall or gypsum board.

Once the conventional prefabricated wall assembly is on-site, a barrier layer, such as Tyvek® is added to the exterior sheathing in an effort to minimize the penetration of the weather elements into the conventional prefabricated wall assembly. However, over time, the weather elements can penetrate or circumvent the barrier layer, thus penetrating the conventional prefabricated wall assembly. Therefore, there remains a need to provide an improved prefabricated wall assembly.

SUMMARY OF THE INVENTION AND ADVANTAGES

A prefabricated wall assembly receives an exterior covering of a building. The prefabricated wall assembly comprises a frame assembly having a top member, a bottom member opposite said top member. The frame assembly also has a plurality of vertical members coupled to and extending between the top and bottom members. The frame assembly has an interior side and an exterior side opposite the interior side.

The prefabricated wall assembly also comprises an outer foam layer coupled to the frame assembly. The outer foam layer extends from the exterior side of the frame assembly to an exterior surface of the outer foam layer. The exterior surface of the outer foam layer is configured to receive the exterior covering of the building.

The outer foam layer comprises a plurality of particles and a binder. The particles and binder define a plurality of pathways extending vertically through the prefabricated wall assembly. The pathways extend from the top member to the bottom member of the frame assembly for allowing airflow and drainage between the frame assembly and the exterior covering. Providing airflow and drainage between the prefabricated wall assembly and the exterior covering prevents environmental elements, such as water, from entering the building. Furthermore, the pathways of the outer foam layer provide the prefabricated wall with an increased thermal resistance.

Additionally, methods of manufacturing the prefabricated wall assembly are disclosed.

BRIEF DESCRIPTION OF THE DRAWINGS

Other advantages of the present invention will be readily appreciated, as the same becomes better understood by reference to the following detailed description, when considered in connection with the accompanying drawings wherein.

DETAILED DESCRIPTION OF THE EXEMPLARY EMBODIMENT

Figure 1:
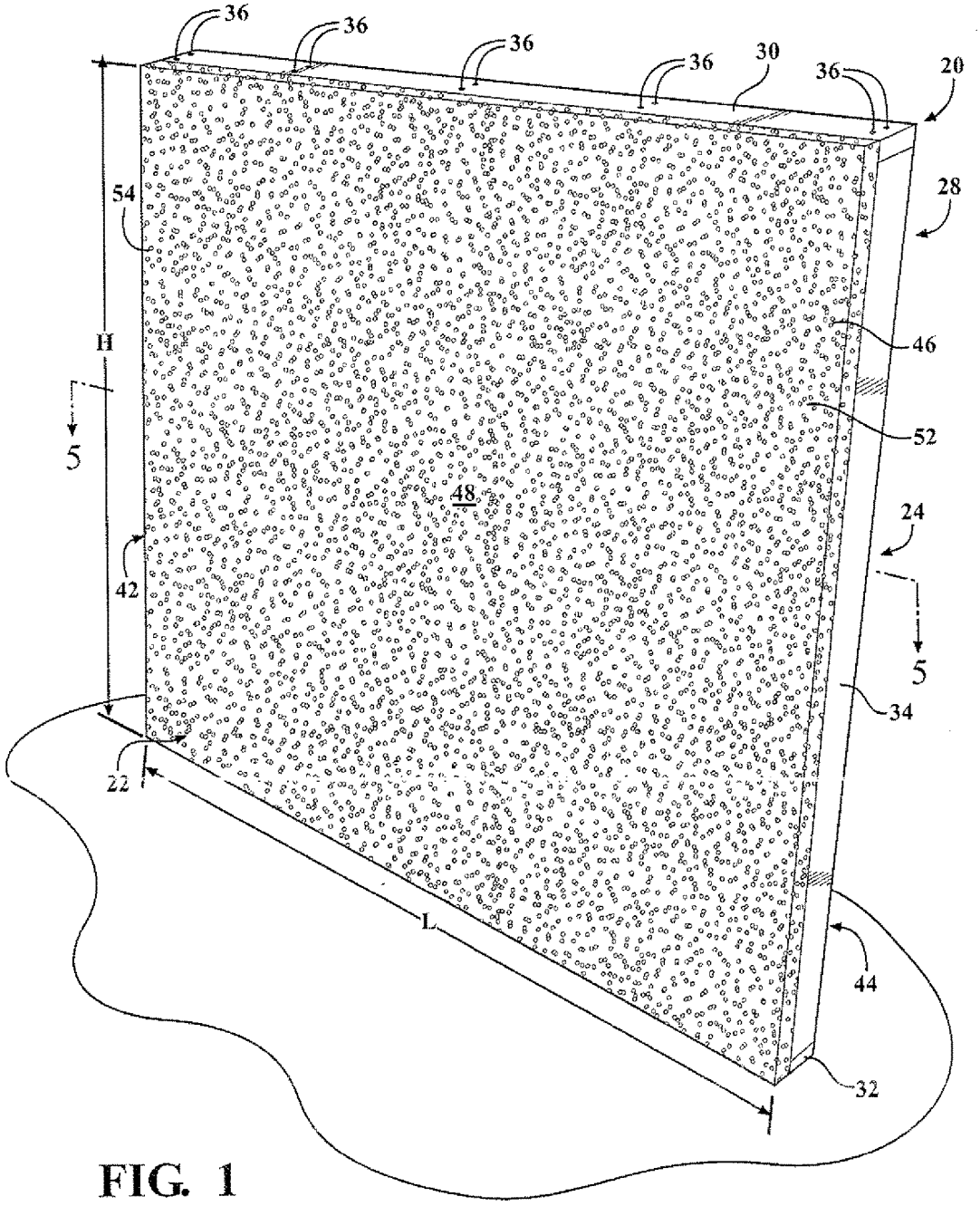
FIG. 1 is a perspective view of an exterior face of a prefabricated wall assembly having a frame assembly and an outer foam layer.

Referring to the Figures, wherein like numerals indicate corresponding parts throughout the several views, a prefabricated wall assembly is generally shown at 20. The prefabricated wall assembly 20 is for constructing a building, such as a residential building or a commercial building. For example, the prefabricated wall assembly 20 is at least one of a plurality of exterior walls of the building. It is to be appreciated that the prefabricated wall assembly 20 may only be one of the plurality of exterior walls of the building or the prefabricated wall assembly 20 may be all of the plurality of exterior walls of the building. Said differently, the prefabricated wall assembly 20 may be used to construct a single exterior wall of the building.

Alternatively, multiple prefabricated wall assemblies may be used to construct the exterior walls of building. Said differently, the prefabricated wall assembly 20 may be coupled to another prefabricated wall assembly 20 to define a perimeter of the building. Additionally, the prefabricated wall assembly 20 may be coupled to a traditional field constructed wall to define the perimeter of the building. It is to be appreciated that the prefabricated wall assembly 20 may be coupled to the traditional field constructed wall or the another prefabricated wall assembly 20 by any suitable methods. For example, fasteners, such as nails or screws, an adhesive bead, or straps could be used to the couple together the adjacent high performance wall assemblies 20.

Generally, the prefabricated wall assembly 20 has an exterior face 22, which faces an exterior of the building when the prefabricated wall assembly 20 is the wall of the building. Additionally, the prefabricated wall assembly 20 has an interior face 24, which faces an interior of the building when the prefabricated wall assembly 20 is the wall of the building. The prefabricated wall assembly 20 can be manufactured in any length L or height H desired for use as the exterior walls of the building. Additionally, the prefabricated wall assembly 20 may be used completely above grade or extend below grade such that a portion of the prefabricated wall assembly 20 is embedded within the ground. Furthermore, the prefabricated wall assembly 20 can be used as interior walls of the building.

Typically, the prefabricated wall assembly 20 is manufactured by assembling the prefabricated wall assembly 20 off-site from the location of the building. Said differently, the prefabricated wall assembly 20 may be manufactured at a location that is different from the location that the building is to be constructed. For example, the prefabricated wall assembly 20 can be manufactured at a factory or a warehouse and subsequently transported to the location that the building is to be constructed. Once the prefabricated wall assembly 20 is delivered on-site, the prefabricated wall assembly 20 is secured in position on a support structure of the building, such as a footer, foundation wall, or another prefabricated wall assembly 20. Alternatively, the prefabricated wall assembly 20 may be manufactured on-site at the location where the building is to be constructed. It is to be appreciated that the prefabricated wall assembly 20 may be positioned with the assistance of machinery, such as a crane. Typically, once the prefabricated wall assembly 20 is secured in position, the prefabricated wall assembly 20 receives an exterior covering 26 of the building, such as siding, brick, and/or an insulating foam panel. However, it is to be appreciated that the prefabricated wall assembly 20 may receive the exterior covering 26 prior to arriving on-site, i.e., in the factor or the warehouse. The exterior covering 26 may be secured to the prefabricated wall assembly 20 by exterior fasteners 27, such as nails, screws, or ties. For example, when the exterior covering 26 is brick, the prefabricated wall assembly 20 may include brick ties as the exterior fasteners 27. Alternatively, the exterior covering 26 may be secured to the prefabricated wall assembly 20 by an adhesive. For example, when the exterior covering 26 is siding, panels of the siding may be adhesively bonded to the prefabricated wall assembly 20.

Figure 2:
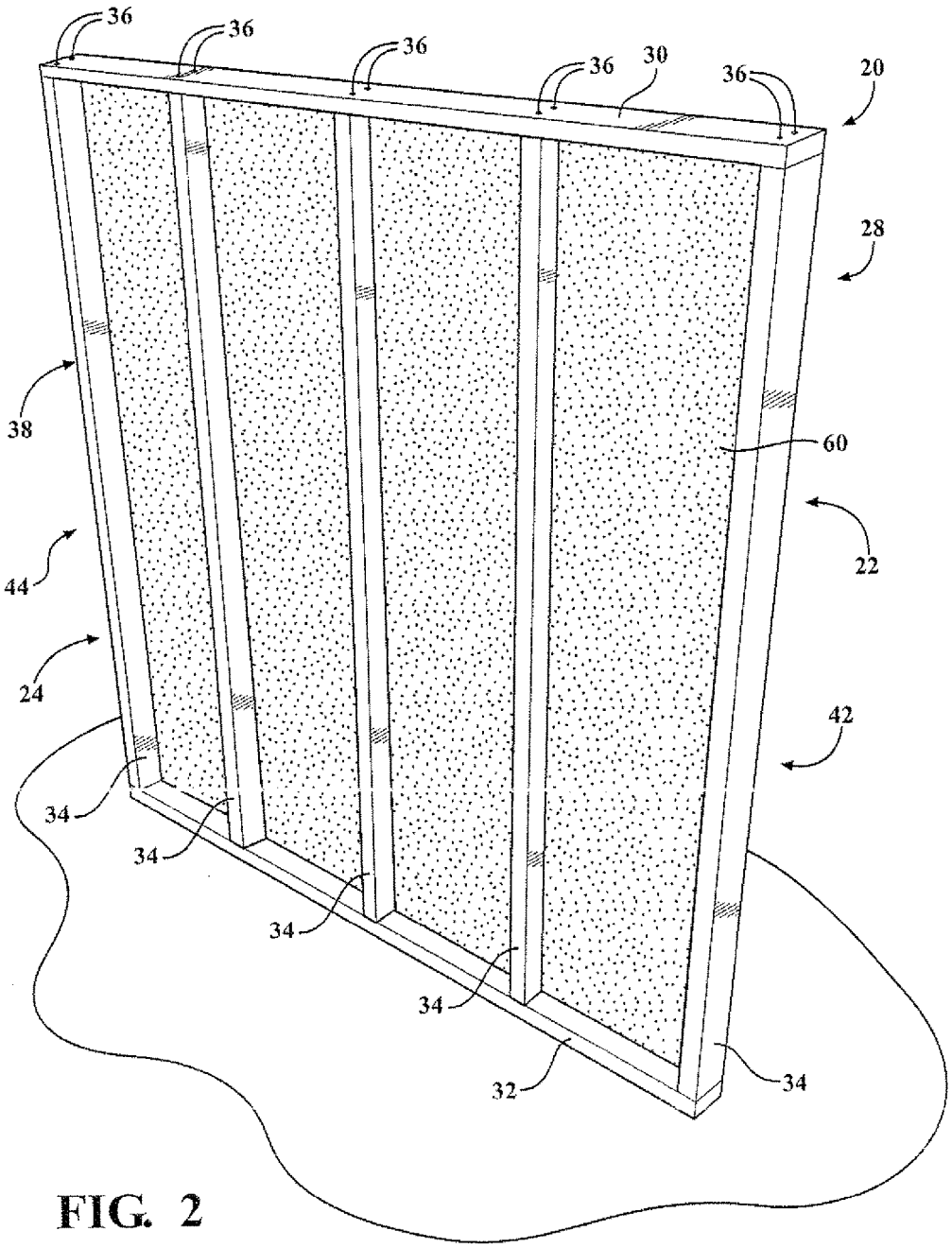
FIG. 2 is a perspective view of an interior face of the prefabricated wall assembly having a frame assembly and an outer foam layer.
Figure 3:
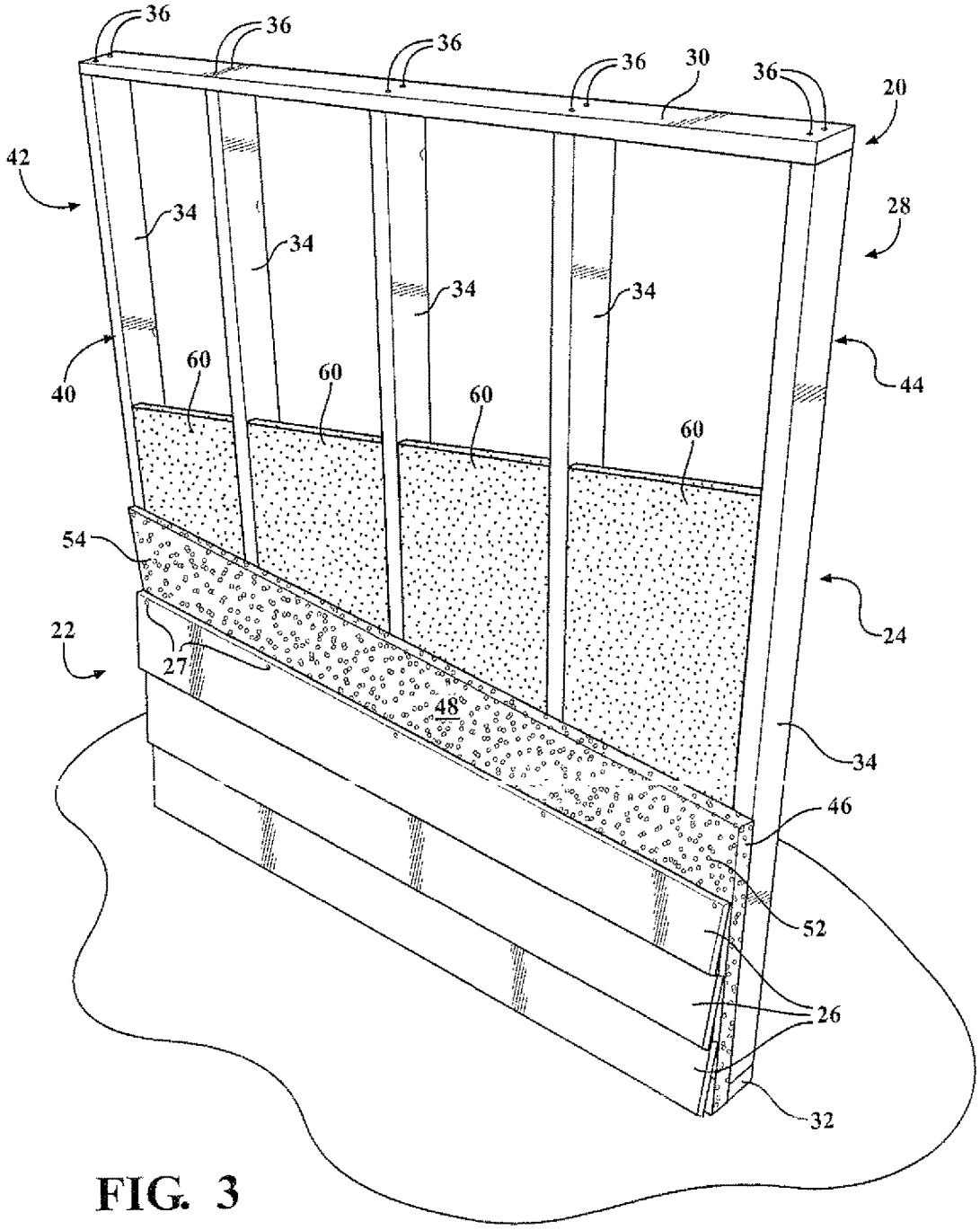
FIG. 3 is another perspective view of the exterior face of the prefabricated wall assembly having an exterior covering coupled to the frame assembly.

With reference to FIGS. 1-3, the prefabricated wall assembly 20 comprises a frame assembly 28. The frame assembly 28 includes a top member 30 and a bottom member 32 spaced from the top member 30. The frame assembly 28 also includes a plurality of vertical members 34 coupled to and extending between the top and bottom members 30, 32. Generally, the top and bottom members 30, 32 are horizontal and the vertical members 34 are perpendicular to the top and bottom members 30, 32. However, it is to be appreciated that the top and bottom members 30, 32 may be vertical with the vertical members 34 extending horizontally between the top and bottom members 30, 32.

The top, bottom, and vertical members 30, 32, 34 are typically coupled together using fasteners 36, such as nails and/or screws. The top, bottom, and vertical members 30, 32, 34 of the frame assembly 28 present an interior side 38 of the frame assembly 28 and an exterior side 40 of the frame assembly 28 opposite the interior side 38. Generally, when the prefabricated wall assembly 20 is secured in position on the support structure of the building, the interior side 38 of the frame assembly 28 faces an interior of the building and the exterior side 40 of the frame assembly 28 faces an exterior of the building. Typically, the bottom member 32 is secured in position on the support structure of the building. The frame assembly 28 may also include a structural support member for providing resistance to axial loads, shear loads, and lateral loads applied to the prefabricated wall assembly 20. For example, the frame assembly 28 may include wind bracing, hurricane straps, and/or up-lifting clips.

Typically, the top, bottom, and vertical members 30, 32, 34 comprise wood. However, it is to be appreciated that the top, bottom, and vertical members 30, 32, 34 may comprise any suitable material, such as fiberglass, aluminum, or other metals. The top, bottom, and vertical members 30, 32, 34 may be of any desired dimensions. For example, the top, bottom, and vertical members 30, 32, 34 may have a nominal cross-section of 2 inches by 4 inches or a nominal cross-section of 2 inches by 6 inches. It is to be appreciated that the top, bottom, and vertical members 30, 32, 34 may be of different dimensions relative to each other. For example, the top and bottom members 30, 32 may have the nominal cross-section of 2 inches by 6 inches and the vertical members 34 may have the nominal cross-section of 2 inches by 4 inches.

Figure 5:
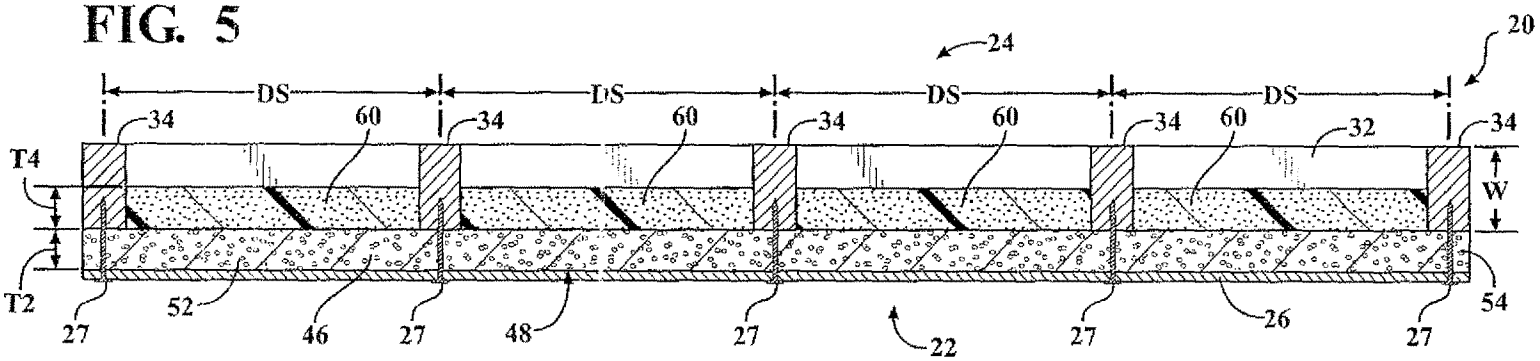
FIG. 5 is a cross-sectional view of the prefabricated wall assembly taken along line 5-5 of FIG. 1.
Figure 6:
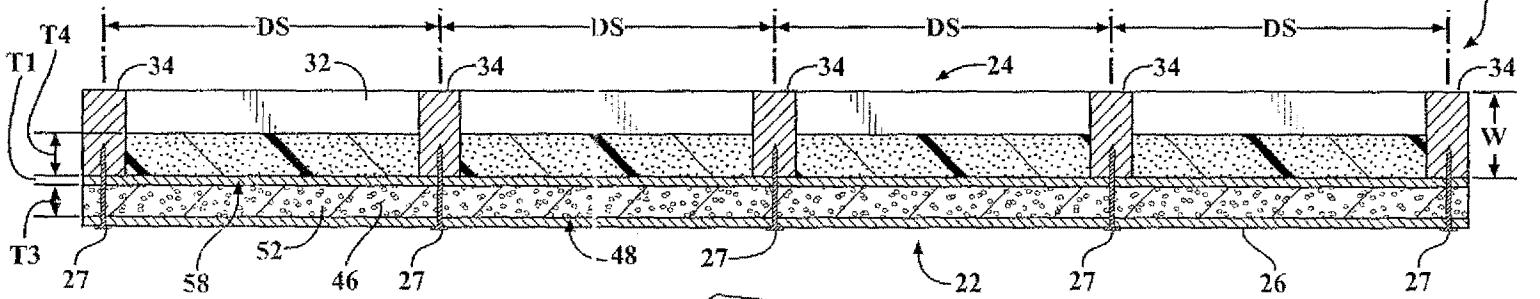
FIG. 6 is a cross-sectional view of the prefabricated wall assembly taken along line 6-6 of FIG. 4.

As best illustrated in FIG. 1, the vertical members 34 along with the top and bottom members 30, 32 define the height H of the prefabricated wall assembly 20. Typically, the height H of the prefabricated wall assembly 20 is of from about 2 to about 24, more typically of from about 6 to about 12, and even more typically of from about 8 to about 12 feet. With reference to FIGS. 5 and 6, a nominal width W of the frame assembly 28 is defined by a width of the top, bottom, and vertical members 30, 32, 34. Typically, the nominal width W of the frame assembly 28 is of from about 1 to about 8, more typically of from about 2 to about 8, and even more typically of from about 4 to about 6 inches.

With reference to FIG. 1-3, the frame assembly 28 has a first end 42 and a second end 44 spaced from the first end 42. Typically, one of the vertical members 34 is disposed at the first end 42 of the frame assembly 28 and another one of the vertical members 34 is disposed at the second end 44 of the frame assembly 28 with other vertical members 34 equally spaced between the first and second ends 42, 44 of the frame assembly 28. The length L of the prefabricated wall assembly 20 is defined between the first and second ends 42, 44 of the frame assembly 28. Additionally, the top and bottom members 30, 32 are generally equal to the length L of the prefabricated wall assembly 20. Typically, the length L of the prefabricated wall assembly 20 is of from about 1 to about 52, more typically of from about 5 to about 25, and even more typically of from about 12 to about 16 feet.

Figure 8:
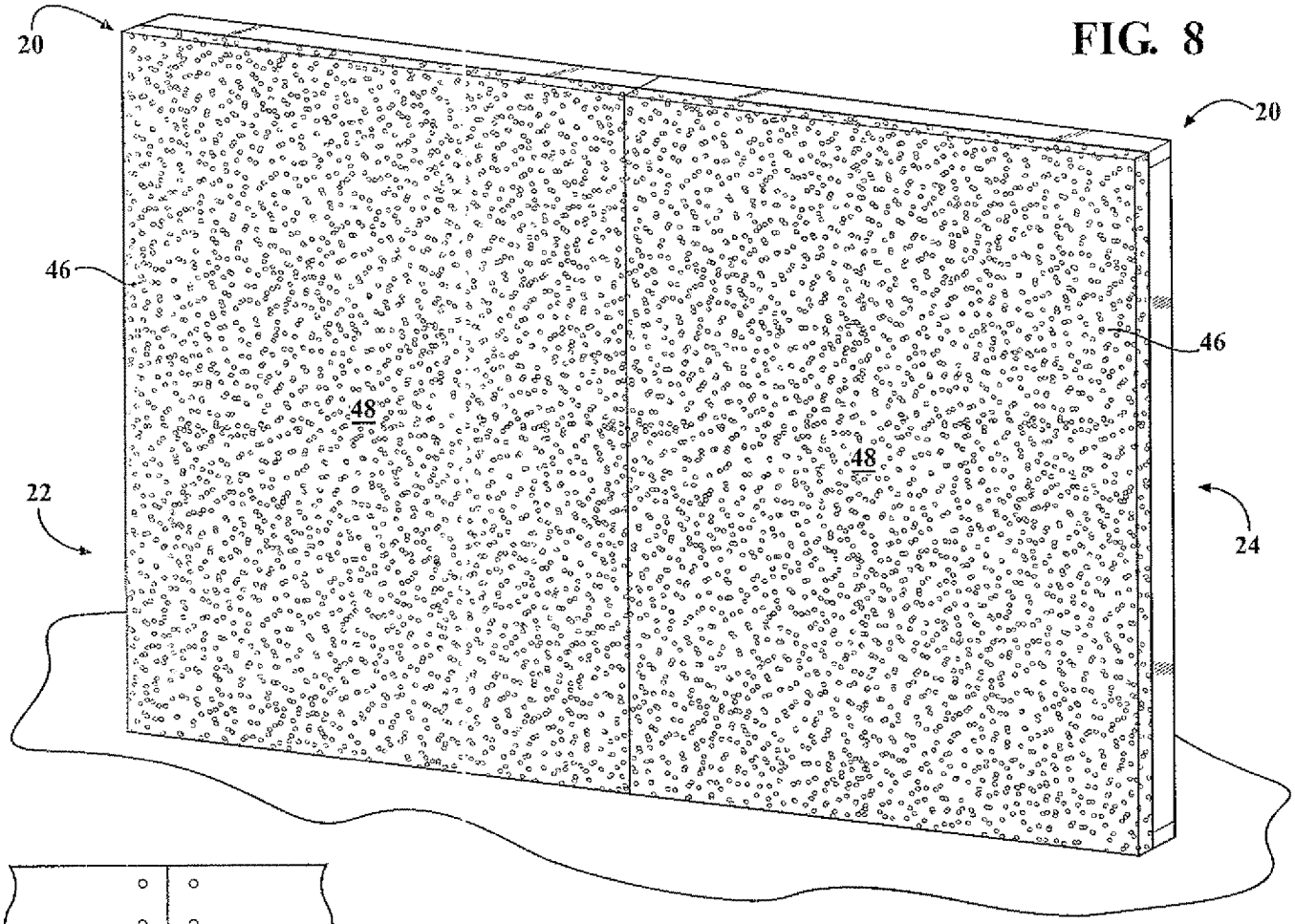
FIG. 8 is a perspective view of the exterior face of two prefabricated wall assemblies joined together.
Figure 9:
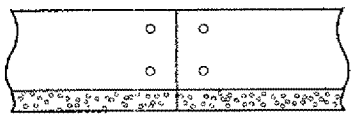
FIG. 9 is a top view of a portion of the prefabricated wall assemblies of FIG. 8.

The length L of the prefabricated wall assembly 20 may vary depending on specific needs of a customer. For example, the length L of the prefabricated wall assembly 20 may be equal to a length of the exterior wall of the building in which the prefabricated wall assembly 20 is to be used. Alternatively, the length L of the prefabricated wall assembly 20 may be shorter than the exterior wall of the building in which the prefabricated wall assembly 20 is to be used such that multiple prefabricated wall assemblies are joined together, as shown in FIGS. 8 and 9, to form a unitary wall of the building.

Figure 10:
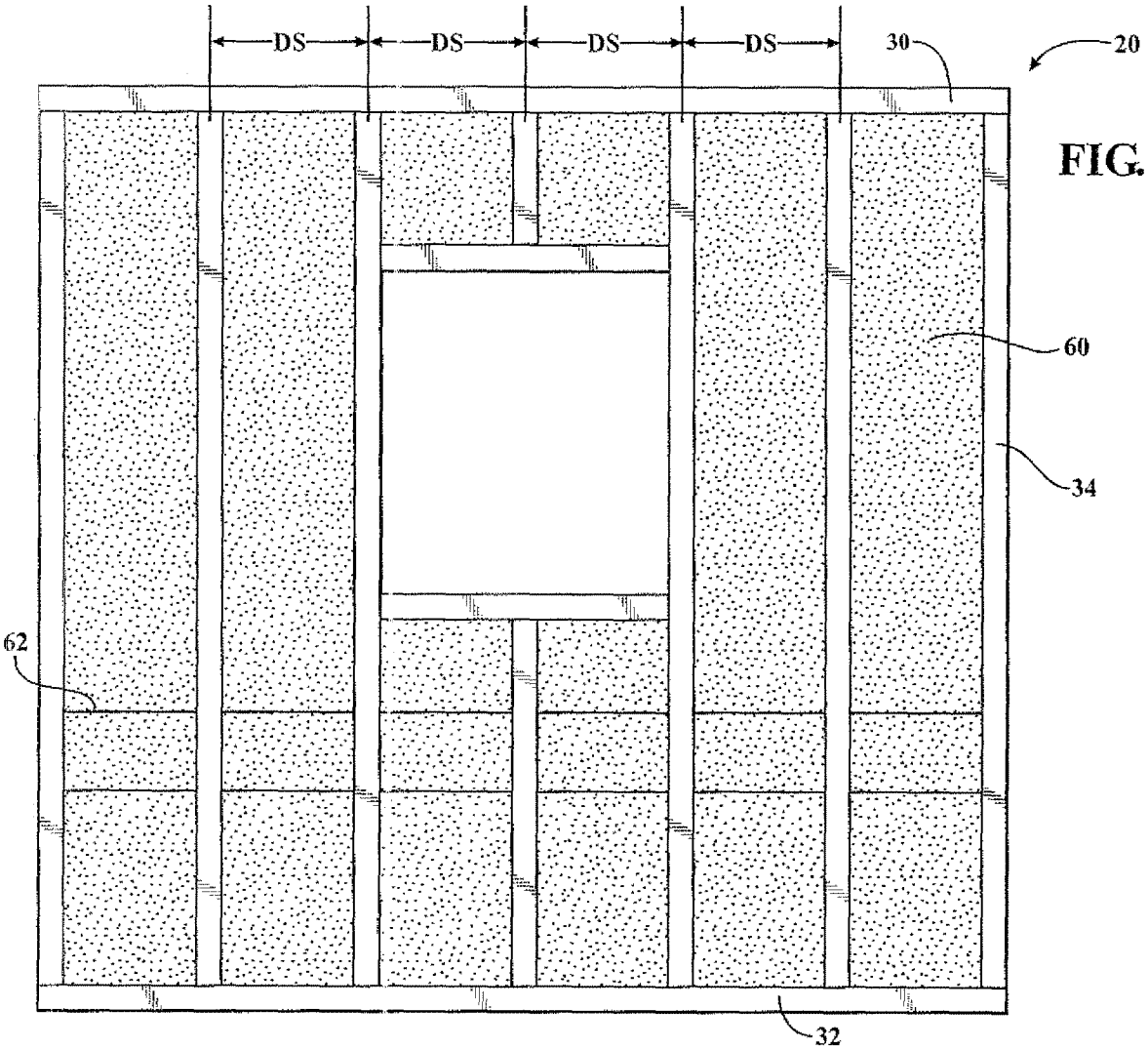
FIG. 10 is a view of the interior face of prefabricated wall assembly having an opening for receiving a window frame.

With reference to FIGS. 5 and 6, the vertical members 34 are typically spaced apart from each other a distance DS. A plurality of voids are defined by the vertical members 34. Said differently, the plurality of voids are between the vertical members 34. Typically, the distance DS is measured from a centerline of one of the vertical members 34 to a centerline of another one of the vertical members 34. As alluded to above, the vertical members 34 are typically equally spaced apart throughout the frame assembly 28. However, it is to be appreciated that the distance DS between adjacent vertical members 34 may vary throughout the frame assembly 28. For example, as shown in FIG. 10, the distance DS between the vertical members 34 may vary for defining an opening in the frame assembly 28 to receive a window frame. It is to be appreciated that the distance DS between the vertical members 34 may vary for defining other openings in the frame assembly 28 to receive other desired structures, such as door frames. The distance DS between adjacent vertical members 34 is typically of from about 1 to about 30, more typically of from about 10 to about 30 even more typically of from about 12 to about 28 inches.

With reference to FIGS. 1-4, the prefabricated wall assembly 20 comprises an outer foam layer 46 coupled to the frame assembly 28. The outer foam layer 46 is generally planar. Said differently, an exterior surface 48 of the outer foam layer 46 is generally parallel to the exterior side 40 of the frame assembly 28. The outer foam layer 46 extends from the exterior side 40 of the frame assembly 28 to the exterior surface 48 of the outer foam layer 46. The exterior surface 48 of the outer foam layer 46 is configured to receive the exterior covering 26 of the building. The outer foam layer 46 spaces the exterior covering 26 from the exterior side 40 of the frame assembly 28.

Figure 7:
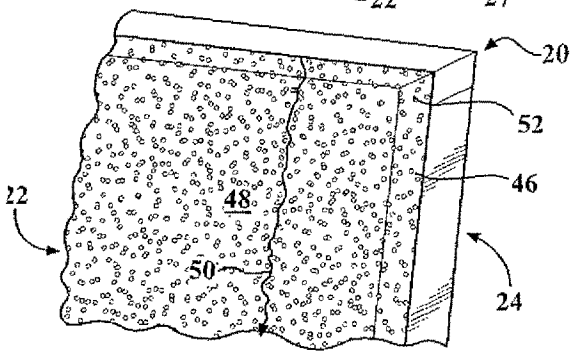
FIG. 7 is an enlarged view of a portion of the prefabricated wall assembly of FIG. 1 showing the outer foam layer defining a plurality of pathways.

Generally, the outer foam layer 46 defines a plurality of pathways 50, as best illustrated in FIG. 7. The pathways 50 allow weather elements, such as water and/or air that penetrate the prefabricated wall assembly 20 to exit the prefabricated wall assembly 20 without entering the building. Said differently, the pathways 50 allow airflow through the prefabricated wall assembly 20 and allows water to drain from the prefabricated wall assembly 20. In other words, the pathways 50 provide airflow channels and drainage paths between the frame assembly 28 and the exterior covering 26. Generally, the pathways 50 are defined vertically along the outer foam layer 46. Said differently, the pathways 50 are defined through the prefabricated wall assembly 20. Typically, the pathways 50 extend from the top member 30 of the frame assembly 28 to the bottom member 32 of the frame assembly 28. Said differently, the pathways 50 span the height H of the prefabricated wall assembly 20. It is to be appreciated that the pathways 50 may be defined in the exterior surface 48 of the outer foam layer 46. In such an embodiment, the exterior covering 26 coupled to the outer foam layer 46 and the outer foam layer 46 itself define the pathways 50. Alternatively, the pathways 50 may be defined within the outer foam layer 46. Said differently, the pathways 50 may be defined internally within the outer foam layer 46.

The pathways 50, which providing the airflow channels and the drainage paths between the prefabricated wall assembly 20 and the exterior covering 26, prevents the weather elements from entering the building. Said differently, weather elements that enter the prefabricated wall assembly 20 will follow the pathways 50 down the prefabricated wall assembly 20 where the weather elements can exit the prefabricated wall assembly 20 rather than enter the building through the prefabricated wall assembly 20. Furthermore, the pathways 50 of the outer foam layer 46 allows positive air flow thought the prefabricated wall assembly 20, which maintains a thermal resistance, or R-value of the prefabricated wall assembly 20. Additionally, the positive airflow through the prefabricated wall assembly 20 limits water adsorption and accelerates drying capacity of the prefabricated wall assembly 20. Furthermore, the positive airflow provides convection cooling to cool the exterior surface 46 of the insulating foam layer 42.

Generally, although the weather elements contact and travel through the pathways 50 of the outer foam layer 46, the outer foam layer 46 limits the infiltration of the weather elements into the building. Said differently, the outer foam layer 46 impedes the infiltration of water vapor into the frame assembly 28 thereby preventing infiltration of the water vapor into the building. Additionally, the outer foam layer 46 may prevent air from infiltrating the prefabricated wall assembly 20, which maintains the thermal resistance of the prefabricated wall assembly 20.

The outer foam layer 46 comprises a plurality of particles 52 and a binder. The particles 52 and binder of the outer foam layer 46 define the pathways 50. Said differently, the particles 52 and the binder define a continuous void space along the outer foam layer 46. It is to be appreciated that the particles 52 may be in contact with each other while still defining the pathways 50. Alternatively, the particles 52 may be spaced from each other to define the pathways 50.

The particles 52 and the binder impart the outer foam layer 46 with strength. More specifically, the outer foam layer 46 has a flexural strength typically greater than 25 psi according to ASTM C 203. Additionally, the outer foam layer 46 has a compressive resistance of 10% deformation at greater than 13 psi according to ASTM D 1621.

Typically, the particles 52 comprise greater than 80, more typically greater than 85, and even more typically greater than 90 percent by volume of the outer foam layer 46. The particles 52 have a density typically of from about 1000 $kg/m_3$ or less, more typically of from about 500 $kg/m_3$ or less, and even more typically less than 300 $kg/m_3$.

Typically, the binder is a polymer. However, it is to be appreciated that the binder may be any suitable material for binding the particles 52 together. The binder can possess adhesive properties, flame retardation properties, heat reflective properties, sound damping properties, or a combination of these. The binder can be prepared from aqueous dispersions that include water and a polymer. The dispersions can be anionic, cationic, or nonionic. Suitable polymers or copolymers for the binder include acrylic-based polymers and copolymers, styrene-acrylic-based copolymers, styrene-butadiene-based copolymers, vinyl acrylic-based copolymers, vinyl acetate based polymers and copolymers (e.g. ethylene vinyl acetate), natural rubber latex, neoprene, and polyurethanes. In some embodiments, the binder includes an acrylic-based polymer or copolymer, a styrene-acrylic-based copolymer, a styrene-butadiene-based copolymer, a vinyl acrylic-based copolymer, a vinyl acetate based polymer or copolymer (e.g. ethylene vinyl acetate), and combinations thereof.

The binder can be derived from one or more monomers. For example, the monomers can include vinyltoluenes (e.g., styrene); conjugated dienes (e.g., isoprene or butadiene); α,β-monoethylenically unsaturated mono- and dicarboxylic acids or anhydrides thereof (e.g., acrylic acid, methacrylic acid, crotonic acid, dimethacrylic acid, ethylacrylic acid, allylacetic acid, vinylacetic acid, maleic acid, fumaric acid, itaconic acid, mesaconic acid, methylenemalonic acid, citraconic acid, maleic anhydride, itaconic anhydride, and methylmalonic anhydride); esters of α,β-monoethylenically unsaturated mono- and dicarboxylic acids having 3 to 6 carbon atoms with alkanols having 1 to 12 carbon atoms (e.g., esters of acrylic acid, methacrylic acid, maleic acid, fumaric acid, or itaconic acid, with C1-C12, C1-C8, or C1-C4 alkanols such as ethyl, n-butyl, isobutyl and 2-ethylhexyl acrylates and methacrylates, dimethyl maleate and n-butyl maleate); acrylamides and alkyl-substituted acrylamides (e.g., (meth)acrylamide, N-tert-butylacrylamide, and N-methyl(meth)acrylamide); (meth)acrylonitrile; vinyl and vinylidene halides (e.g., vinyl chloride and vinylidene chloride); vinyl esters of C1-C18 mono- or dicarboxylic acids (e.g., vinyl acetate, vinyl propionate, vinyl n-butyrate, vinyl laurate and vinyl stearate); C1-C4 hydroxyalkyl esters of C3-C6 mono- or dicarboxylic acids, especially of acrylic acid, methacrylic acid or maleic acid, or their derivatives alkoxylated with from 2 to 50 moles of ethylene oxide, propylene oxide, butylene oxide and combinations thereof, or esters of these acids with C1-C18 alcohols alkoxylated with from 2 to 50 mol of ethylene oxide, propylene oxide, butylene oxide and combinations thereof (e.g., hydroxyethyl (meth)acrylate, hydroxypropyl (meth)acrylate, and methylpolyglycol acrylate); and monomers containing glycidyl groups (e.g., glycidyl methacrylate).

Additional monomers or co-monomers that can be used include linear 1-olefins, branched-chain 1-olefins or cyclic olefins (e.g., ethene, propene, butene, isobutene, pentene, cyclopentene, hexene, and cyclohexene); vinyl and allyl alkyl ethers having 1 to 40 carbon atoms in the alkyl radical, wherein the alkyl radical can possibly carry further substituents such as a hydroxyl group, an amino or dialkylamino group, or one or more alkoxylated groups (e.g., methyl vinyl ether, ethyl vinyl ether, propyl vinyl ether, isobutyl vinyl ether, 2-ethylhexyl vinyl ether, vinyl cyclohexyl ether, vinyl 4-hydroxybutyl ether, decyl vinyl ether, dodecyl vinyl ether, octadecyl vinyl ether, 2-(diethylamino)ethyl vinyl ether, 2-(di-n-butylamino)ethyl vinyl ether, methyldiglycol vinyl ether, and the corresponding allyl ethers); sulfo-functional monomers (e.g., allylsulfonic acid, methallylsulfonic acid, styrenesulfonate, vinylsulfonic acid, allyloxybenzenesulfonic acid, 2-acrylamido-2-methylpropanesulfonic acid, and their corresponding alkali metal or ammonium salts, sulfopropyl acrylate and sulfopropyl methacrylate); vinylphosphonic acid, dimethyl vinylphosphonate, and other phosphorus monomers; alkylaminoalkyl (meth)acrylates or alkylaminoalkyl(meth)acrylamides or quaternization products thereof (e.g., 2-(N,N-dimethylamino)ethyl (meth)acrylate, 3-(N,N-dimethylamino)propyl (meth)acrylate, 2-(N,N,N-trimethylammonium)ethyl (meth)acrylate chloride, 2-dimethylaminoethyl(meth)acrylamide, 3-dimethylaminopropyl(meth)acrylamide, and 3-trimethylammoniumpropyl (meth)acrylamide chloride); allyl esters of C1-C30 monocarboxylic acids; N-vinyl compounds (e.g., N-vinylformamide, N-vinyl-N-methylformamide, N-vinylpyrrolidone, N-vinylimidazole, 1-vinyl-2-methylimidazole, 1-vinyl-2-methylimidazoline, N-vinylcaprolactam, vinylcarbazole, 2-vinylpyridine, and 4-vinylpyridine).

The monomers used may include cross-linking monomers, such as divinylbenzene; 1,4-butanediol diacrylate; methacrylic acid anhydride; monomers containing 1,3-diketo groups (e.g., acetoacetoxyethyl(meth)acrylate or diacetonacrylamide); monomers containing urea groups (e.g., ureidoethyl (meth)acrylate, acrylamidoglycolic acid, and methacrylamidoglycolate methyl ether); and silane cross-linkers (e.g., 3-methacryloxypropyl trimethoxysilane and 3-mercaptopropyl trimethoxysilane). Additional examples of cross-linkers include N-alkylolamides of α,β-monoethylenically unsaturated carboxylic acids having 3 to 10 carbon atoms and esters thereof with alcohols having 1 to 4 carbon atoms (e.g., N-methylolacrylamide and N-methylolmethacrylamide); glyoxal based cross-linkers; monomers containing two vinyl radicals; monomers containing two vinylidene radicals; and monomers containing two alkenyl radicals. Exemplary cross-linking monomers include diesters or triesters of dihydric and trihydric alcohols with α,β-monoethylenic ally unsaturated monocarboxylic acids (e.g., di(meth)acrylates, tri(meth)acrylates), of which in turn acrylic acid and methacrylic acid can be employed. Examples of such monomers containing two non-conjugated ethylenically unsaturated double bonds are alkylene glycol diacrylates and dimethacrylates, such as ethylene glycol diacrylate, 1,3-butylene glycol diacrylate, 1,4-butylene glycol diacrylate and propylene glycol diacrylate, vinyl methacrylate, vinyl acrylate, allyl methacrylate, allyl acrylate, diallyl maleate, diallyl fumarate and methylenebisacrylamide.

Functional groups present in the cross-linking monomers included in the binder described herein can be cross-linked by a chemical reagent. The chemical reagent is capable of cross-linking the functional groups of the cross-linking monomers to form, for example, covalent bonds, ionic bonds, hydrogen bonds, metallic bonds, dipole-dipole interactions, and cation-pi interactions.

Chemical reagents useful in the aqueous latex dispersions described herein include, for example, divalent and multivalent cations, such as zirconium (e.g., ammonium zirconium carbonate), zinc (e.g., zinc oxide and/or zinc peroxide), calcium, magnesium, aluminum, iron, tin, titanium, antimony, vanadium, and combinations thereof. Other suitable chemical reagents include carbodiimides (e.g., polycarbodiimides), polyisocyanates, organosilanes (e.g., epoxysilanes), urea-formaldehyde resins, melamine-formaldehyde resins, epoxy containing compounds, aziridines, acrylamides (e.g., N-methyloylacrylamide), hydrazides (e.g., adipic acid dihydrazide), glyoxal condensates, oxazolines, polyethylenimines, polyamines, dialdehydes, and combinations thereof.

The copolymer included in the binder can be prepared by heterophase polymerization techniques, including, for example, free-radical emulsion polymerization, suspension polymerization, and mini-emulsion polymerization. In some examples, the binder is prepared by polymerizing the monomers using free-radical emulsion polymerization. The emulsion polymerization temperature is generally from 10° C. to 95° C. or from 75° C. to 90° C. The polymerization medium can include water alone or a mixture of water and water-miscible liquids, such as methanol. In some embodiments, water is used alone. The emulsion polymerization can be carried out either as a batch, semi-batch, or continuous process. Typically, a semi-batch process is used. In some embodiments, a portion of the monomers can be heated to the polymerization temperature and partially polymerized, and the remainder of the polymerization batch can be subsequently fed to the polymerization zone continuously, in steps or with superposition of a concentration gradient.

The free-radical emulsion polymerization can be carried out in the presence of a free-radical polymerization initiator. The free-radical polymerization initiators that can be used in the process are all those which are capable of initiating a free-radical aqueous emulsion polymerization including alkali metal peroxydisulfates and $H_2O_2$, or azo compounds. Combined systems can also be used comprising at least one organic reducing agent and at least one peroxide and/or hydroperoxide, e.g., tert-butyl hydroperoxide and the sodium metal salt of hydroxymethanesulfinic acid or hydrogen peroxide and ascorbic acid. Combined systems can also be used additionally containing a small amount of a metal compound which is soluble in the polymerization medium and whose metallic component can exist in more than one oxidation state, e.g., ascorbic acid/iron(II) sulfate/hydrogen peroxide, where ascorbic acid can be replaced by the sodium metal salt of hydroxymethanesulfinic acid, sodium sulfite, sodium hydrogen sulfite or sodium metal bisulfite and hydrogen peroxide can be replaced by tert-butyl hydroperoxide or alkali metal peroxydisulfates and/or ammonium peroxydisulfates. In the combined systems, the carbohydrate derived compound can also be used as the reducing component. In general, the amount of free-radical initiator systems employed can be from 0.1 to 2%, based on the total amount of the monomers to be polymerized. In some embodiments, the initiators are ammonium and/or alkali metal peroxydisulfates (e.g., sodium persulfate), alone or as a constituent of combined systems. The manner in which the free-radical initiator system is added to the polymerization reactor during the free-radical aqueous emulsion polymerization is not critical. It can either all be introduced into the polymerization reactor at the beginning, or added continuously or stepwise as it is consumed during the free-radical aqueous emulsion polymerization. In detail, this depends in a manner known to an average person skilled in the art both from the chemical nature of the initiator system and on the polymerization temperature. In some embodiments, some is introduced at the beginning and the remainder is added to the polymerization zone as it is consumed. It is also possible to carry out the free-radical aqueous emulsion polymerization under superatmospheric or reduced pressure.

In addition, small amounts (e.g., from 0.01 to 2% by weight based on the total monomer weight) of molecular weight regulators, such as tert-dodecyl mercaptan, can optionally be used. Such substances are added to the polymerization zone in a mixture with the monomers to be polymerized and are considered part of the total amount of unsaturated monomers used in the copolymer.

In some examples, the polymer for use in the binder has a glass transition temperature ($T_g$), as measured by differential scanning calorimetry, less than or equal to the temperature of the room in which the binder is used (e.g., in an attic, the $T_g$ is 65° C. or less). For example, the $T_g$ of the binder copolymer can be 50° C. or less, 40° C. or less, 30° C. or less, 20° C. or less, or 10° C. or less.

The polymers for use in the binder can include self-cross-linking polymers or cross-linkable polymers. Specific examples of useful polymers for inclusion in the binder described herein include, but are not limited to, ACRONAL NX 4787, acrylic polymers commercially available from BASF Corporation (Florham Park, N.J.). The polymers for use in the binder can also include flame retardant polymers.

The binder described herein can include adhesives or sealants. Examples of suitable adhesives include thermosetting adhesives, thermoplastic adhesives, elastomeric adhesives, and hybrid adhesives. The adhesives can be structural adhesives such as epoxies, epoxy hybrids, formaldehyde based adhesives (e.g., resorcinol formaldehyde, phenol resorcinol formaldehyde, melamine formaldehyde, and urea formaldehyde), phenolics and modified phenolics (nitrile-phenolics, vinyl-phenolics, and neoprene-phenolics), polyaromatic high temperature resins (e.g., polyimides, bismaleimides, and polybenzimidazoles), polyesters, polyurethanes, anaerobic resins, cyanoacrylates, and modified acrylics. Additionally, the adhesives can be non-structural adhesives such as elastomeric resins (e.g., natural rubber, asphalt, reclaimed rubber, butyl rubber, styrene butadiene rubber, polychloroprene, acrylonitrile butadiene, polyisobutylene, polyvinyl methyl ether, polysulfide, and silicone). The adhesives can also be thermoplastic resins, such as polyvinyl acetal, polyvinyl acetate, polyvinyl alcohol, thermoplastic elastomers, ethylene vinyl acetate, cellulosic resins, polyamide, polyester, polyolefins, polysulfone, phenoxy, and acrylic resins. Further, the adhesives can be naturally occurring resins such as natural organic resins (e.g., glues of agricultural or animal origin) or inorganic adhesives and cements (e.g., sodium silicate, phosphate cements, litharge cement, and sulfur cement).

Examples of suitable sealants include hardening and non-hardening sealants, two-part system sealants, single component sealants, and solvent and water release sealants. These sealants can be low performance sealants (e.g., oil- and resin-based sealants, asphaltic and other bituminous mastics, polyvinyl acetate, epoxy, and polyvinyl chloride plastisol), medium performance sealants (e.g., hydrocarbon rubber-based sealants, acrylic, chlorosulfonated polyethylene, and hot-melt sealants), or high performance sealants (e.g., fluorosilicone and fluoropolymer sealants, polysulfides, polyethers, polyurethanes, silicones, styrene butadiene copolymers, and chloroprenes). These and other suitable adhesives and sealants are described in detail in E. M. Petrie, "Handbook of Adhesives and Sealants, Chapter 8: Adhesive Classification, Chapter 10: Adhesive Families, Chapter 12: Sealant Classification and Composition, and Chapter 13: Sealant Families," McGraw-Hill, New York, 2000.

The binder described herein can have a solids percentage of 40% to 85%. For example, the binder can have a solids percentage from 50% to 80%, from 55% to 75%, or from 60% to 70%.

In some examples, the binder is substantially free of curing agents or cross-linking agents. "Substantially free" means that the binder can include less than 0.1%, less than 0.01%, less than 0.001%, less than 0.0001%, or 0% of curing agents or cross-linking agents based on the weight of the binder. In other examples, the binder contains reactive groups that can bond with one or more reactive groups present in the plurality of particles 52.

The particles 52, as described herein, can be pre-expanded polymers that can be fully expanded or partially expanded, for example, with air. For example, the pre-expanded polymer can comprise of from 50 to 99 percent air by volume. The pre-expanded polymer can be previously expanded with an organic blowing agent, such as a hydrocarbon like pentane, isopentane, butane and combinations thereof. Alternatively, the pre-expanded polymer can be previously expanded with an inorganic blowing agent, such an air, carbon dioxide, nitrogen, argon, and combinations thereof. It is to be appreciated that the pre-expanded polymer can be partially expanded, such that the pre-expanded polymer is capable of further expansion, or can be fully expanded. Typically, the pre-expanded polymer is greater than of about 50, more typically greater than 60, and even more typically greater than 70 percent expanded.

The particles 52 can be polymeric particles, non-polymeric particles, and combinations thereof. For example, the particles 52 can be inorganic microspheres and lightweight inorganic particles, such as inorganic particles with a density of from about 10 to 20 kg/m$^3$.

The pre-expanded polymer can be derived from expanded polymers, including thermoplastic polymers. Examples of pre-expanded polymers include polystyrene (e.g. free-radical-polymerized glass-clear polystyrene (GPPS) or anionically polymerized polystyrene (APS)), styrene-based-copolymers (e.g., styrene-maleic anhydride copolymers, styrene-butadiene copolymers, styrene-α-methylstyrene copolymers, acrylonitrile-butadiene-styrene (ABS) copolymers, styrene-acrylonitrile (SAN) copolymers, styrene-methyl methacrylate copolymers, acrylonitrile-styrene-acrylate (ASA) copolymers, methacrylate-butadiene-styrene (MBS) copolymers, or methyl methacrylate-acrylonitrile-butadiene-styrene (MABS) copolymers), polyethylene (e.g., low density polyethylene, high density polyethylene, and linear low-density polyethylene), polypropylene, polyesters, polyacrylic esters, polymethacrylic esters, thermoplastic polyurethane and polyamides, and combinations thereof. Further examples of suitable pre-expanded polymers include polyphenylene oxide, polystyrene-polyphenylene oxide blends, polyoxymethylene, poly(methyl methacrylate), methyl methacrylate copolymers, ethylene-propylene copolymers (e.g., random and block), ethylene-vinyl acetate copolymers, polycarbonate, polyethylene terephthalate, aromatic polyester/polyether glycol block copolymer, polyethylene and polymerized vinyl aromatic resins. Examples of vinyl aromatic resins include the solid homopolymers of styrene, vinyltoluene, vinylxylene, ethylvinylbenzene, isopropylstyrene, t-butylstyrene, chlorostyrene, dichlorostyrene, fluorostyrene, bromostyrene; the solid copolymers of two or more monovinyl aromatic compounds; and the solid copolymers of one or more of monovinyl aromatic compounds and a copolymerizable olefinic compound (e.g., acrylonitrile, methyl methacrylate, or ethyl acrylate). In some examples, the pre-expanded polymer includes a mixture of polystyrene and polyvinyl chloride. Examples of suitable commercially available pre-expanded polymers include NEOPOR and STYROPOR, expandable polystyrenes commercially available from BASF Corporation (Florham Park, N.J.); and DUALITE, a heat expandable polymeric microsphere commercially available from Henkel Corporation (Dusseldorf, Germany).

In some examples, the plurality of particles 52 includes inorganic particles. The inorganic particles can be hollow, solid, macroporous, inert, and/or non-toxic. Examples of inorganic particles include, but are not limited to, expanded perlite, hollow glass particles, for example those sold under the trademark NOBLITE® (Noble International; France) or amorphous sililca, for example sold under the trademark such as Nanogel from Aspen Cabot®.

Each of the plurality of particles 52 is not limited in shape. For example, each of the plurality of particles 52 can be beads, flakes, fibers, rods, disks, cubes, cylinders, pyramids, cones, cuboids, spheres, granules, platelets, microballoons, and combinations thereof. In some examples, the plurality of particles 52 are uniform in shape (e.g., beads only). In other examples, the plurality of particles 52 includes a mixture of two or more shapes (e.g., beads, spheres, and flakes). In some embodiments, the plurality of particles 52 are small in size and of low density and overall weight. For example, the average particle size of the largest dimension of the plurality of particles 52 is from 0.1 to 10 mm. However, it is to be appreciated that the plurality of particles 52 may include multiple particle sizes. For example, the plurality of particles 52 can include small (i.e., the largest dimension of the pre-expanded polymer is less than 1.0 mm), medium (i.e., the largest dimension of the pre-expanded polymer is from 1.0 to 2.0 mm), and large (i.e., the largest dimension of the pre-expanded polymer is greater than 2.0 mm, such as, for example, from 2.0 mm to 10 mm) particle sizes to provide a closely packed yet breathable barrier, which still defines the pathways 50.

The plurality of particles 52 can be flame retardant. Additionally, flame retardant materials can be added to the binder. Generally, the flame retardant properties of the particles 52 and the binder provide the outer foam layer 46 with a flame resistance that meets ASTM E-84. An example of suitable flame retardant materials for the binder include non-halogenated flame retardant to provide the desired level of flame resistance required. Flame retardant particles can include pre-expanded polymers STYROPOR BF and NEOPOR, expandable polystyrenes commercially available from BASF Corporation (Florham Park, N.J.), and inorganic particles.

Additionally, phosphorus flame retardants can be added to the binder and be either inorganic or organic based. This includes organic phosphate esters, phosphates and inorganic phosphorous containing salts. Phosphate moiety can also be incorporated into the binder. Furthermore, metal hydroxides can be added to the binder formulation to enhance flame resistance, including aluminum trihydrate and magnesium hydroxide. Borates can be used alone or in combination with aluminum trihydrate and magnesium hydroxide. Suitable borates include sodium borate, boric acid and zinc borate. Polydimethylsiloxane alone or in combination with the above mention retardants can also be used. Conventional fillers can be supplemented with silica and talc to further enhance the flame resistance of the insulation drainage board.

The plurality of particles 52 can include insulating materials (e.g. fiberglass, rockwool, expanded polystyrene, polyiscyanurate and polyurethane). The plurality of particles 52 can further include recycled material. The recycled materials can be insulating materials. For example, the plurality of particles 52 can include recycled materials such as polymeric organic materials (e.g. polystyrene, polyurethane and polyisocyanurate), inorganic materials (e.g. carbonates, clay, mica, stone, glass, and metal oxides), and combinations thereof. Organic polymers include, for example, filled and unfilled thermoset/thermoplastic polymers. Examples of filled polymers materials are reinforced reaction injection molded (RRIM) thermoset plastic materials that have an organic component comprising substantially polyurethanes; unreacted precursors of the RRIM polymer such as polyols and isocyanates; sheet molding compounds (SMC) which have an organic component comprising styrene cross-linked polyesters; uncured SMC reactants comprising styrene and unsaturated polyesters; and epoxies, phenolics, silicates, melamines, diallylphthalates, and polyimides as are typically used in reinforced plastics. Examples of useful unfilled polymer materials are reaction injection molded (RIM) plastics, such as unreinforced RIM polyurethanes and polyureas, polyethylenes, polyethylene terephthalate, polystyrenes, and scrap rubber tires that comprise filled or unfilled polymer materials. The recycled polymer materials, inorganic recycled materials, and composite recycled products typically are ground, shredded, or otherwise comminuted before inclusion in the plurality of particles 52 and can include lightweight or foamed polymer materials such as, but not limited to, ground expanded polystyrene, polyurethane, and other lightweight materials. The plurality of particles 52 can comprise greater than 80% by volume of the composition. For example, the plurality of particles 52 can comprise greater than 60%, greater than 70%, greater than 80%, greater than 90%, or greater than 95% by volume of the composition.

The outer foam layer 46 may include a filler, such as heat reflective material, fire retardants, and impact modifiers. Fillers suitable for use in the compositions described herein include ground/recycled glass (e.g., window or bottle glass), milled glass, glass spheres, glass flakes, glass fibers, clays (e.g., kaolin), feldspar, mica, talc, activated carbon, metals and alloys (e.g., nickel, copper, aluminum, silicon, solder, silver, and gold), metal-plated particulates (e.g., silver-plated copper, silver-plated nickel, and silver-plated glass microspheres), sol-gel ceramics (e.g., sol-gel $SiO_2$, $TiO_2$ or $Al_2O_3$), precipitated ceramics (such as $SiO_2$, $TiO_2$ or $Al_2O_3$), ceramic microspheres, fused silica, fumed silica, amorphous fused silica, aluminum trihydrate (ATH), sand, ground sand, slate dust, crusher fines, red mud, amorphous carbon (e.g., carbon black), wollastonite, alumina, bentonite, quartz, garnet, saponite, beidellite, granite, calcium carbonate, calcium oxide, calcium hydroxide, antimony trioxide, barium sulfate, magnesium oxide, titanium dioxide, zinc carbonate, zinc oxide, nepheline syenite, perlite, diatomite, pyrophillite, soda ash, trona, and organic or inorganic fibers. For example, the filler can include calcium carbonate and/or aluminum trihydrate. In some examples, the filler can include heat and/or infrared reflective materials, such as those present in RADIANCE e-0.25 AB-C, an acrylic copolymer emulsion/pigment blend commercially available from BASF Corporation (Florham Park, N.J.), and other pigments or metallic flake materials (e.g., aluminum flake materials). In some examples, the composition can include a liquid flame retardant, for example, in an amount of 0 to 30% by weight of the composition. The composition can also include additives such as antioxidants, thickeners, fungicides, biocides, surfactants, defoamers, coalescing agents, tackifiers, plasticizers, dispersants, rheology modifiers, dyes, freeze-thaw agents, wetting agents, other formulating agents, and combinations thereof.

Examples of suitable heat reflective material include, but are not limited to, graphite, and pigments. Examples of suitable materials for use as the outer foam layer are described in U.S. Provisional Patent Application No. 61/387,778 filed on Sep. 29, 2010, which is incorporated by reference.

Generally, the particles 52 and the binder are mixed to form the outer foam layer 46. The binder coats the particles 52 and is cured to form the outer foam layer 46. The outer foam layer 46, once the binder is cured, can provide insulating properties. For example, R values of the cured outer foam layer 46 can range 1-12 from 0.5 per inch to 4 per inch.

Figure 4:
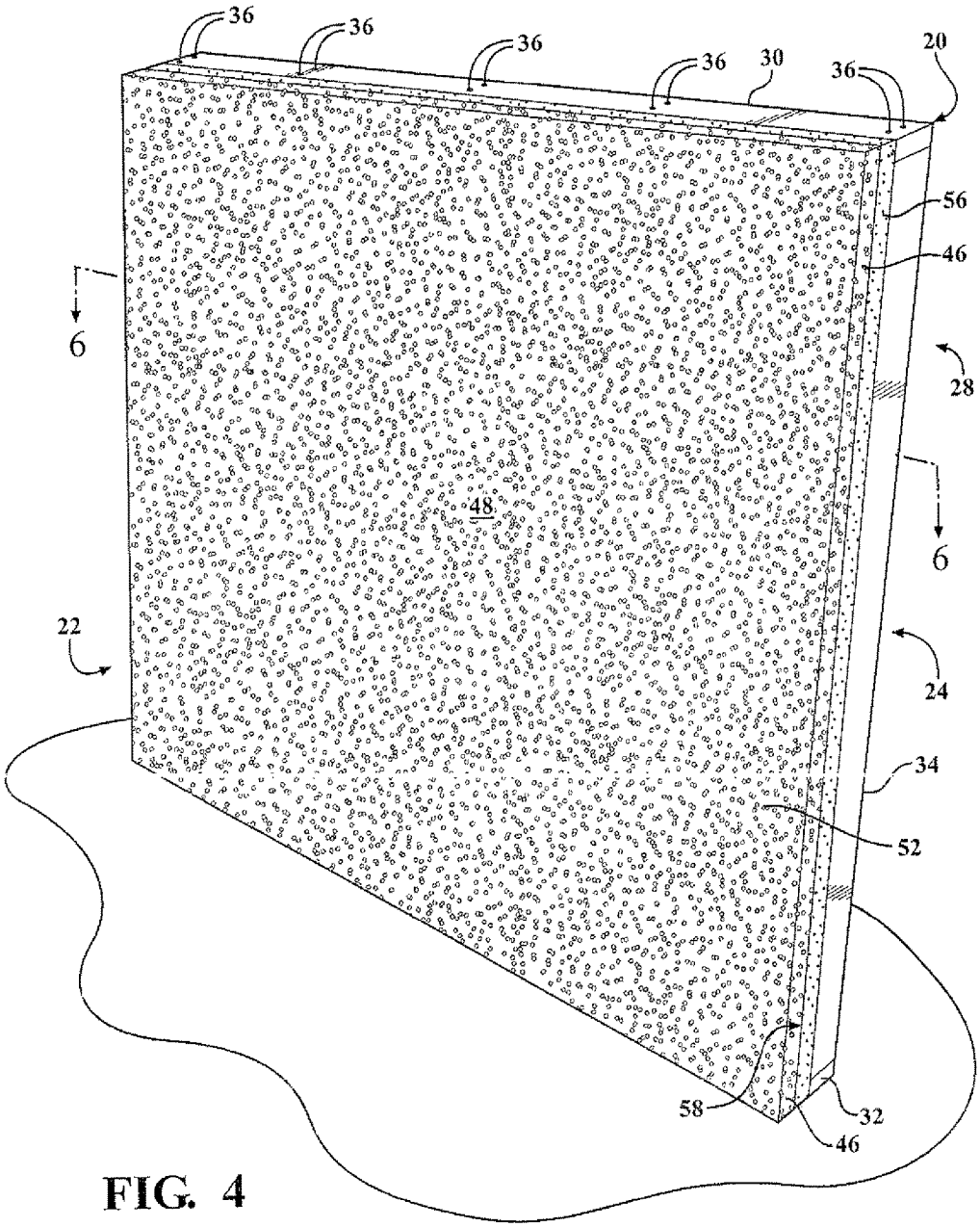
FIG. 4 is a perspective view of an exterior face of the prefabricated wall assembly with the outer foam layer coupled to an intermediate substrate.
Figure 4A:
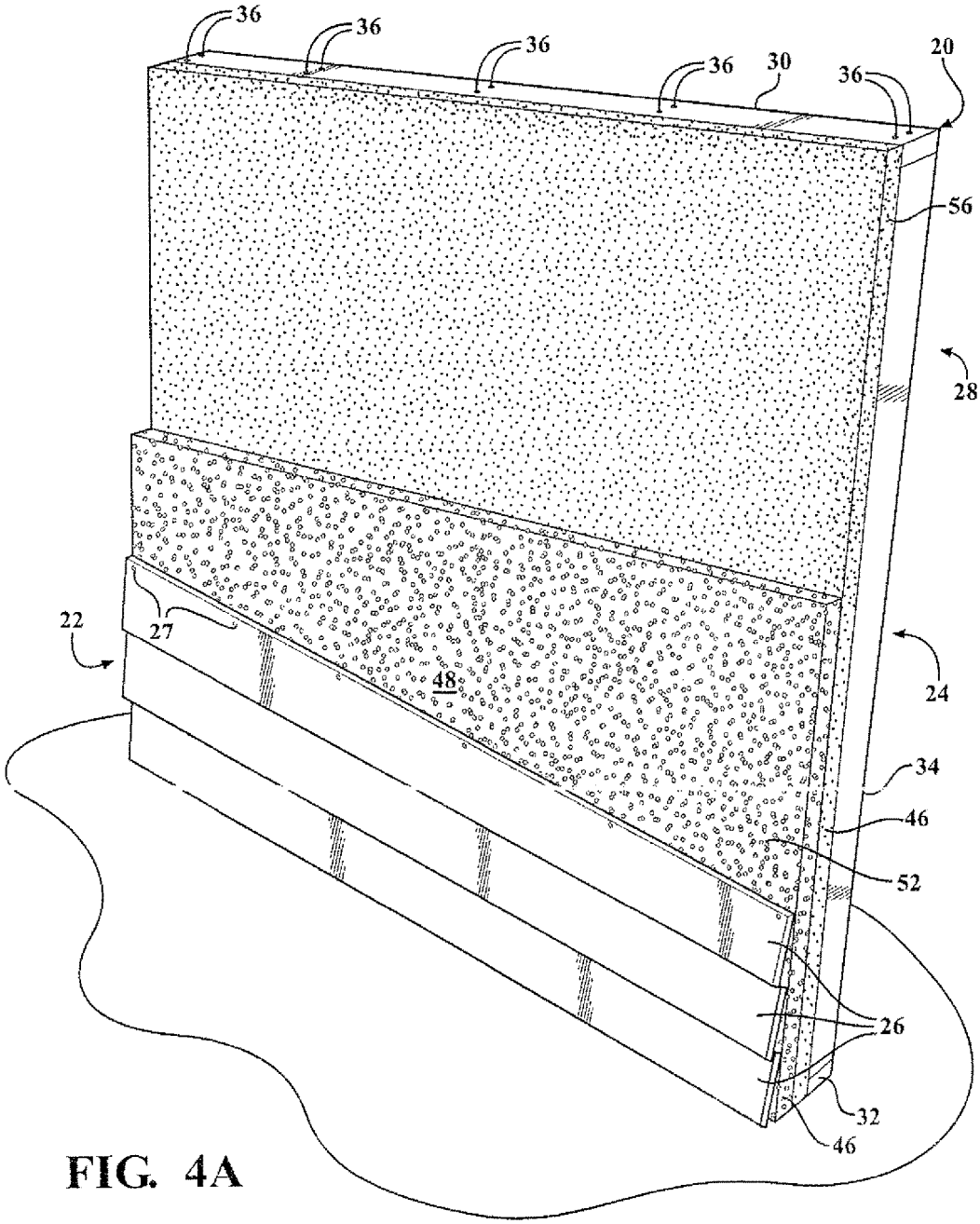

It is to be appreciated that the particles 52 and binder may be formed and cured to form preformed panels 54 with the preformed panels 54 subsequently applied to the frame assembly 28. Alternatively, as shown in FIGS. 4 and 6, the particles 52 and the binder may be applied to an intermediate substrate 56, which is coupled to the frame assembly 28. Once the particles 52 and the binder are applied to the intermediate substrate 56, the binder is cured to form the outer foam layer 46, with the outer foam layer 46 providing a continuous, bonded, insulation, drainage layer. As such, the intermediate substrate 56 is disposed between the outer foam layer 46 and the frame assembly 28. The intermediate substrate 56 may be an intermediate foam layer comprising a foam selected from the group of polyurethane foams, polyurea foams, and combinations thereof. In such an embodiment, the particles 52 and the binder are applied to and cured on the intermediate foam layer to bond the outer foam layer 46 to the intermediate foam layer. It is to be appreciated that the intermediate foam layer may be any suitable material, such a plywood and OSB board.

The intermediate substrate 56 is coupled to the frame assembly 28 thereby coupling the outer foam layer 46 to the frame assembly 28. The intermediate substrate 56 has a thickness T1 typically of from about 0.125 to about 6.00, more typically of from about 0.50 to about 3.00, and even more typically of from about 0.50 to about 1.00 inches.

With reference to FIGS. 1-3, when the outer foam layer 46 is the preformed panels 54, the preformed panels 54 are coupled to the frame assembly 28. The preformed panels 54 may be formed by mixing the particles 52 and the binder in a mold, which has a desired dimension. Alternatively, the preformed panels 54 may be produced in a continuous line process and then cut to the desired dimensions.

The preformed panels 54 may be coupled directly to the frame assembly 28 by the fasteners 36. Alternatively, the preformed panels 54 may be adhesively bonded to the frame assembly 28. Typically, when the preformed panels 54 are used, the outer foam layer 46 has a thickness T2 of from about 0.25 to about 3.50, more typically of from about 0.25 to about 2.00, and even more typically or from about 0.50 to about 1.50 inches. Additionally, when the preformed panels 54 are used, the outer foam layer 46 has a density of from about 1.00 to about 5.00, more typically of from about 1.00 to about 4.50, and even more typically of from about 1.00 to about 2.00 pounds per cubic foot. Furthermore, when the preformed panels 54 are used, the outer foam layer 46 typically has an R-value of from about 1.00 to about 9.00, and more typically, 3.00, to about 6.00 per inch.

Typically, when the particles 52 and the binder are cured on the intermediate substrate 56, the particles 52 and the binder are mixed to form a fluid composition prior to coupling the outer foam layer 46 to the frame assembly 28. For example, the fluid composition may be rolled or brushed onto the frame assembly 28. More typically, when the particles 52 and the binder are cured on the intermediate substrate 56, the particles 52 and the binder are mixed to form a sprayable composition. For example, the sprayable composition may be sprayed onto an exterior side 58 of the intermediate substrate 56. It is to be appreciated that the particles 52 and the binder may be mixed to form the sprayable composition prior to applying the sprayable composition to the intermediate substrate 56. For example, the sprayable composition may be formed and subsequently sprayed onto the exterior side 58 of the intermediate substrate 56 to apply the sprayable composition on the intermediate substrate 56.

Alternatively, the particles 52 and the binder may be mixed together on the exterior side 58 of the intermediate substrate 56. For example, a first stream comprising of the binder may be sprayed onto the exterior side 58 of the intermediate substrate 56 to apply the binder to the intermediate substrate 56 and a second stream comprising the particles 52 may be sprayed or blown onto the binder, which was previously applied to the exterior side 58 of the intermediate substrate 58. It is to be appreciated that the first and second streams may be simultaneously sprayed onto the exterior side 58 of the intermediate substrate 56. It is also to be appreciated that the binder and/or the particles 52 may be applied with more than one stream.

Typically, when the fluid composition or the sprayable composition are used, the outer foam layer is seamless across the length L of said frame assembly. Additionally, when the fluid composition or the sprayable composition are used, the outer foam layer 46 has a thickness T3 of from about 0.01 to about 0.50 inches. Additionally, when the fluid composition or the sprayable composition are used, the outer foam layer 46 has a density of from about 0.5 to about 5.00 pounds per cubic foot. Furthermore, when the fluid composition or the sprayable composition are used, the outer foam layer 46 typically has an R-value of from about 1.00 to about 9.00 and more typically of from about 3.00 to about 6.00 per inch.

The prefabricated wall assembly 20 may include an inner foam layer 60. The inner foam layer 60 is disposed between the vertical members 30. It is to be appreciated that the inner foam layer 60 may be in contact with the vertical members 30 or, alternatively, the inner foam layer 60 may be spaced from the vertical members 30 while still being disposed between the vertical members 30. When the intermediate foam layer is present, the inner foam layer 60 may be bonded to the intermediate substrate 56 for coupling the intermediate substrate 56 to the frame assembly 28. For example, the inner foam layer 60 may be bonded to the intermediate foam layer for coupling the intermediate foam layer to the frame assembly 28. Additionally, when the outer foam layer 46 is the preformed panels 54, the inner foam layer 60 may be bonded to the preformed panels 54 for coupling the preformed panels 54 to the frame assembly 28.

The inner foam layer 60 is typically selected from the group of polyurethane foams, polyurea foams, and combinations thereof. However, it is to be appreciated that the inner foam layer 60 may be any suitable material. For example, the inner foam layer 60 may comprises a sprayable foam selected from the group of polyurethane sprayable foams, polyurea sprayable foams, and combinations thereof. However, the sprayable foam may be selected from the group of acrylic foams, latex foams, melamine foams, isocyanurate foams, and silicone foams. When the sprayable foam is a polyurethane sprayable foam, the sprayable foam may be the reaction product of a polyether polyol and an isocyanate. It is to be appreciated that any polyether polyols may be used. Alternatively, when the sprayable foam is the polyurethane sprayable foam, the sprayable foam may be the reaction product of a polyester polyol and the isocyanate. The use of the polyester polyol imparts the outer foam layer 46 with a fire retardant. When the sprayable foam is a polyurea sprayable foam, the sprayable foam is the reaction product of a polyamine and an isocyanate. An example of an isocyanate suitable for the sprayable foam is lubrinate.

The inner foam layer 60 has a thickness T4 typically of from about 0.5 to about 5.5, more typically of from about 1.0 to about 3.0, and even more typically of from about 1.5 to about 2.5 inches. It is to be appreciated that the inner foam layer 60 may extend into the frame assembly 28 the entire nominal width W of the frame member such that the inner foam layer 60 fills the plurality of voids that are defined by the plurality of vertical members 34. Said differently, the thickness T4 of the inner foam layer 60 may be equal to the nominal width W of the frame assembly 28. Alternatively, the inner foam layer 60 may only extend into a portion of the nominal width W of the frame assembly 28 such that the plurality of voids defined by the plurality of vertical members 34 is not completely filled.

Generally, the inner foam layer 60 provides structural support to the frame assembly 28. Said differently, the inner foam layer 60 may couple the top, bottom, and vertical members 30, 32, 34 together thereby reducing the number of fasteners 36 needed to structurally secure the top, bottom, and vertical members 30, 32, 34 together. Furthermore, the inner foam layer 60 may completely eliminate the need for fasteners 36 to couple together the top, bottom, and vertical members 30, 32, 34 such that the frame assembly 28 is free of fasteners 36 while still meeting structural requirements.

Typically, the inner foam layer 60 and the intermediate substrate 56 are discrete components relative to each other. Said differently, the inner foam layer 60 and the intermediate substrate 56 may be separate components relative to one another. However, the inner foam layer 60 and the intermediate substrate 56 may be integral. For example, when the intermediate substrate 56 is the intermediate foam layer, the intermediate foam layer and the inner foam layer 60 may be a single unitary sheet formed simultaneously with one another.

Generally, the outer foam layer 46 and, if present, the intermediate substrate 56 and the inner foam layer 60 provide the prefabricated wall assembly 20 with the thermal resistance. Said differently, the outer foam layer 46, the intermediate substrate 56, and the inner foam layer 60 insulate the prefabricated wall assembly 20. The thickness T2 or T3 of the outer foam layer 46, the intermediate substrate 56, and the inner foam layer 60 may be varied to adjust the thermal resistance of the prefabricated wall assembly 20. Generally, a desired thermal resistance varies depending on the climate of the location where the building is to be constructed. As such, the thickness T2 or T3 of the outer foam layer 46, the intermediate foam layer, and the inner foam layer 60 may be adjusted to provide the prefabricated wall assembly 20 with the desired thermal resistance. Typically, when the intermediate substrate 56 is the intermediate foam layer, the thermal resistance of the intermediate foam layer has an R-value of from about 3.00 to about 9.00 per inch. As such, the thermal resistance of the prefabricated wall assembly 20 typically has an R-value of from about 10 to about 53, more typically of from about 10 to about 30, and even more typically of from about 12 to about 28 per inch.

As introduced above, the outer foam layer 46 is typically applied to the frame assembly 28 off-site from the location where the building is to be constructed. For example, the prefabricated wall assembly 20 may be manufactured at a location that is different from the location that the building is to be constructed, such as the factory or warehouse.

Manufacturing the prefabricated wall assembly 20 off-site decreases labor cost for constructing the building and decreases construction time required to construct the building once the prefabricated wall assembly 20 is on-site.

The prefabricated wall assembly 20 may comprise a barrier layer coupled to the exterior surface 48 of the outer foam material 46. The barrier layer may be an additional vapor retarder, and/or a radiant barrier. The barrier layer may be any suitable vapor retarder or radiant barrier, including sprayable vapor retarders and radiant barriers. Typically, the vapor retarder and/or the radiant barrier is applied to the exterior surface 48 of the outer foam layer 46.

With reference to FIG. 10, a chase portion 62 may be formed in the inner foam layer 60 for receiving utilities, such as electrical wires and/or plumbing. It is to be appreciated that the chase portion 62 may run vertically within the inner foam layer 60 such that the chase portion 62 are parallel to the vertical members 34 or the chase portion 62 may run horizontally within the inner foam layer 60 such that the chase portion 62 are perpendicular to the vertical members 34.

A method of manufacturing the prefabricated wall assembly 20 includes the step of assembling the frame assembly 28 with the plurality of vertical members 34 coupled between the top member 30 and the bottom member 32. The intermediate substrate 56 is then coupled to the exterior side 40 of the frame assembly 28. It is to be appreciated that the step of coupling the intermediate substrate 56 to the frame assembly 28 may be further defined as applying the inner foam layer 60 to the intermediate substrate 56 between the vertical members 34 of the frame assembly 28 to bond the intermediate substrate 56 to the frame assembly 28. The outer foam layer 46 is applied to the intermediate substrate 56 opposite the frame assembly 28. It is to be appreciated that the outer foam layer 46 and/or the intermediate substrate 56 may be coupled to the frame assembly 28 either on-site where the building is to be constructed or off-site at a factory or warehouse.

As described above, the preformed panels 54 may be applied to the frame assembly 28 with the preformed panels 54 being the outer foam layer 46. As such, the method may include the step of providing the preformed panels 54. Alternatively, the outer foam layer 46 may be sprayed, brushed or rolled onto the intermediate substrate 56. When the preformed panels 54 are employed, the binder and the plurality of particles 52 may be molded to form the prefabricated panels. Additionally, when the preformed panels 54 are used, the preformed panels 54 are positioned adjacent the frame assembly 28. Typically, the preformed panels 54 are positioned on the ground and the frame assembly 28 is set onto of the preformed panels 54. However, the preformed panels 54 may be positioned adjacent the frame assembly 28 by any acceptable method.

The inner foam layer 60 may be applied to the preformed panels 54 between the vertical members 34 of the frame assembly 28. Generally, the inner foam layer 60 is applied by spraying the foam onto the preformed panels 54 between the vertical members 34 of the frame assembly 28 and curing the foam to form the inner foam layer 60. The inner layer bonds the preformed panels 54 to the frame assembly 28

Depending on whether the preformed panels 54 are used or the outer foam layer 46 is spray applied to the intermediate substrate 56, the binder is cured to form the preformed panels 54 or to bond the particles 52 to the intermediate substrate 56. It is to be appreciated that the step of curing the binder may be passive, i.e., there is no need for an affirmative step, such as heating, etc. to cure the binder. Said differently, the binder may cure naturally via a respective curing mechanism of the binder composition. Alternatively, an affirmative step, such as applying heat to the binder, may be required to cure the binder.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A wall assembly comprising:

a frame assembly having a top member, a bottom member opposite said top member, and a plurality of vertical members coupled to and extending between said top and bottom members with said frame assembly having an interior side and an exterior side opposite said interior side, wherein said top member, said bottom member, and said vertical members are made of wood;

an inner foam layer disposed between and bonded to said vertical members of said frame assembly, wherein said inner foam layer is a sprayed foam selected from the group of polyurethane foams, polyurea foams, and combinations thereof;

an outer foam layer directly adjacent said exterior side of said frame assembly and extending from said exterior side of said frame assembly and terminating at an exterior surface of said outer foam layer;

wherein said outer foam layer is a non-concrete layer comprising a plurality of pre-expanded polymeric beads having multiple bead sizes and a binder that define a plurality of non-straight pathways extending vertically from said top member toward said bottom member of said frame assembly through said outer foam layer for allowing airflow and drainage, wherein said pre-expanded polymeric beads are selected from the group of polystyrene, styrene based-copolymers, polyethylene, polypropylene, polyesters, polyvinylchloride, cellulose acetate; and an exterior covering disposed directly adjacent said exterior surface of said outer foam layer and a plurality of fasteners extending through said exterior covering and said outer foam layer and attached to said frame assembly.

2. A wall assembly as set forth in claim 1 further comprising an intermediate substrate disposed between said outer foam layer and said frame assembly with said outer foam layer bonded to said intermediate substrate and said intermediate substrate coupled to said frame assembly for coupling said outer foam layer to said frame assembly.

3. A wall assembly as set forth in claim 2 wherein said intermediate substrate has a thickness of from 0.125 to 6.00 inches.

4. A wall assembly as set forth in claim 1 wherein said inner foam layer has a thickness of from 0.5 to 5.5 inches.

5. A wall assembly as set forth in claim 1 wherein said outer foam layer has a thickness of from 0.25 to 3.50 inches and said outer foam layer has a density of from about 1.00 to 5.00 pounds per cubic foot.

6. A wall assembly as set forth in claim 1 wherein said binder is a polymer selected from the group of acrylic-based polymers or copolymers, styrene-acrylic-based copolymers, styrenebutadiene-based copolymers, vinyl acrylic-based copolymers, vinyl acetate based polymers or copolymers, polyvinylidene chloride, neoprene, natural rubber latex, polyurethane based polymers and combinations thereof.

7. A wall assembly as set forth in claim 1 wherein said frame assembly has a first end and a second end spaced from said first end defining a length of the wall assembly and said outer foam layer is seamless across said length of said frame assembly.

8. A wall assembly as set forth in claim 1 wherein said outer foam layer is a preformed panel.

9. A wall assembly as set forth in claim 1 wherein said exterior surface of said outer foam layer is free of vertical grooves in communication with said pathways.

10. A wall assembly comprising:

a frame assembly having a top member, a bottom member opposite said top member, and a plurality of vertical members coupled to and extending between said top and bottom members with said frame assembly having an interior side and an exterior side opposite said interior side, wherein said top member, said bottom member, and said vertical members are made of wood;

an inner foam layer disposed between and bonded to said vertical members of said frame assembly, wherein said inner foam layer is a sprayed foam selected from the group of polyurethane foams, polyurea foams, and combinations thereof, wherein said inner foam layer has a thickness of from 0.5 to 5.5 inches;

an outer foam layer directly adjacent said exterior side of said frame assembly and extending from said exterior side of said frame assembly and terminating at an exterior surface of said outer foam layer;

wherein said outer foam layer is a non-concrete layer comprising a plurality of pre-expanded polymeric beads having multiple bead sizes and a binder that define a plurality of non-straight pathways extending vertically from said top member toward said bottom member of said frame assembly through said outer foam layer for allowing airflow and drainage, wherein said pre-expanded polymeric beads are selected from the group of polystyrene, styrene based-copolymers, polyethylene, polypropylene, polyesters, polyvinylchloride, cellulose acetate, wherein said binder is a polymer selected from the group of acrylic-based polymers or copolymers, styrene-acrylic-based copolymers, styrenebutadiene-based copolymers, vinyl acrylic-based copolymers, vinyl acetate based polymers or copolymers, polyvinylidene chloride, neoprene, natural rubber latex, polyurethane based polymers and combinations thereof, wherein said outer foam layer has a thickness of from 0.25 to 3.50 inches and said outer foam layer has a density of from 1.00 to 5.00 pounds per cubic foot, wherein said exterior surface of said outer foam layer is free of vertical grooves in communication with said pathways;

wherein said frame assembly has a first end and a second end spaced from said first end defining a length of the wall assembly and said outer foam layer is seamless across said length of said frame assembly; and an exterior covering disposed directly adjacent said exterior surface of said outer foam layer and a plurality of fasteners extending through said exterior covering and said outer foam layer and attached to said frame assembly.

11. A wall assembly comprising:

a frame assembly having a top member, a bottom member opposite said top member, and a plurality of vertical members coupled to and extending between said top and bottom members with said frame assembly having an interior side and an exterior side opposite said interior side, wherein said top member, said bottom member, and said vertical members are made of wood;

an inner foam layer disposed between and bonded to said vertical members of said frame assembly, wherein said inner foam layer is a sprayed foam selected from the group of polyurethane foams, polyurea foams, and combinations thereof, wherein said inner foam layer has a thickness of from 0.5 to 5.5 inches;

an outer foam layer directly adjacent said exterior side of said frame assembly and extending from said exterior side of said frame assembly and terminating at an exterior surface of said outer foam layer;

wherein said outer foam layer is a non-concrete layer comprising a plurality of pre-expanded polymeric beads having multiple bead sizes and a binder that define a plurality of non-straight pathways extending vertically from said top member toward said bottom member of said frame assembly through said outer foam layer for allowing airflow and drainage, wherein said pre-expanded polymeric beads are selected from the group of polystyrene, styrene based-copolymers, polyethylene, polypropylene, polyesters, polyvinylchloride, cellulose acetate, wherein said binder is a polymer selected from the group of acrylic-based polymers or copolymers, styrene-acrylic-based copolymers, styrenebutadiene-based copolymers, vinyl acrylic-based copolymers, vinyl acetate based polymers or copolymers, polyvinylidene chloride, neoprene, natural rubber latex, polyurethane based polymers and combinations thereof, wherein said outer foam layer has a thickness of from 0.25 to 3.50 inches and said outer foam layer has a density of from 1.00 to 5.00 pounds per cubic foot, wherein said exterior surface of said outer foam layer is free of vertical grooves in communication with said pathways;

an intermediate substrate disposed between said outer foam layer and said frame assembly with said outer foam layer bonded to said intermediate substrate and said intermediate substrate bonded to said inner foam layer for coupling to said frame assembly, wherein said intermediate substrate has a thickness of from 0.125 to 6.00 inches;

wherein said frame assembly has a first end and a second end spaced from said first end defining a length of the wall assembly and said outer foam layer is seamless across said length of said frame assembly; and an exterior covering disposed directly adjacent said exterior surface of said outer foam layer and a plurality of fasteners extending through said exterior covering and said outer foam layer and attached to said frame assembly.

* * * * *